US005105487A

United States Patent [19]

Hakamiun et al.

[11] Patent Number: 5,105,487

[45] Date of Patent: Apr. 21, 1992

[54] APPARATUS FOR PATIENT ELEVATION ABOVE A FLUIDIZED SURFACE

[75] Inventors: Reza Hakamiun, Charleston; John A. Brenner, Ladson; Benjamin Salvatini, Goose Creek, all of S.C.; Robert L. Sainte, Winchester, Ky.

[73] Assignee: SSI Medical Services, Inc., Charleston, S.C.

[21] Appl. No.: 628,598

[22] Filed: Dec. 17, 1990

[51] Int. Cl.[5] ..... A16G 7/05

[52] U.S. Cl. ..... 5/614; 5/449; 5/633; 5/912

[58] Field of Search ..... 5/71, 72, 77, 66, 88, 5/424, 432, 433, 453, 449

[56] References Cited

U.S. PATENT DOCUMENTS

| | | | |
|---|---|---|---|
| 1,021,693 | 3/1912 | McGary | 5/433 |
| 3,724,003 | 4/1973 | Ellwanger | 5/66 |
| 4,435,862 | 3/1984 | King | 5/66 |
| 4,463,463 | 8/1984 | Kaneko | 5/424 |
| 4,527,298 | 7/1985 | Moulton | 5/66 |
| 4,535,492 | 8/1985 | Sebest | 5/72 |
| 4,672,699 | 6/1987 | Goodwin . | |
| 4,724,554 | 2/1988 | Kowalski | 5/424 |
| 4,769,584 | 9/1988 | Irigoyen | 5/66 |
| 4,942,635 | 7/1990 | Hargest et al. . | |

FOREIGN PATENT DOCUMENTS

| | | | |
|---|---|---|---|
| 77743 | 8/1919 | Fed. Rep. of Germany | 5/72 |
| 2215996 | 10/1989 | United Kingdom | 5/433 |

*Primary Examiner*—Renee S. Luebke

*Assistant Examiner*—F. Saether

*Attorney, Agent, or Firm*—Dority & Manning

[57] ABSTRACT

An apparatus for patient elevation above a fluidized surface includes a web of filter sheet material disposed beneath the patient and between the patient and the main filter sheet that covers the fluidized surface. The web is loosely mounted about a pair of support rods which are connected via a pair of splice bar linkages to a pair of dual acting hydraulic cylinders. Activation of the cylinders causes the two rods to separate from one another. The separation takes up the slack in the web and renders it taut about the two support rods. Further activation of the cylinders elevates the two support rods above the fluidized surface by pivoting them through the splice bar linkages. This raises the web and the patient supported on the web. A solenoid valve is provided in the hydraulic circuit to enable rapid lowering of the support rods and the web when an emergency procedure such as CPR must be administered to the patient. A pressure switch, a relay, and magnetic reed switches cooperate to prevent the cylinders from applying pressure through the support rods to any person's extremity interposed between the two suppport rods or between the support rods and the fluidized or other surface of the patient support system. Relief valves also are provided to accomplish the same result. Pressure compensated flow control valves control the speed with which the support rods are raised and lowered. A manual dump valve bypasses all of the electrically actuatable valves to enable the operator to lower the support rods in the event of electrical power failure.

36 Claims, 9 Drawing Sheets

APPARATUS FOR PATIENT ELEVATION ABOVE A FLUIDIZED SURFACE

BACKGROUND OF THE INVENTION

The present invention relates to apparatus and method for patient elevation and more particularly to apparatus and method for elevation of a patient confined to a fluidized bed.

Fluidized patient support systems such as disclosed in U.S. Pat. No. 4,672,699 to Goodwin, the contents of which patent are hereby incorporated herein by reference, have provided significant relief to patients who are immobilized for extended recuperative periods of time and/or who have particularly sensitive skin conditions, such as burn patients or patients with bed sores. While conventional hospital beds can be provided with articulatable sections so as to be able to raise the head and chest of the patient for example, it is practically impossible to articulate the fluidized surface portion of a fluidized patient support system. A hybrid system comprising a fluidized patient support surface connected via an articulatable carriage to a plurality of inflatable sacks is capable of articulating the head and chest of the patient, while the lower torso of the patient remains supported by a fluidized surface. Such system is disclosed in U.S. Pat. No. 4,942,635 to Hargest et al, the contents of which patent are hereby incorporated herein by reference.

However, raising the head and chest of the patient which is supported by a fluidized surface poses many problems. Various inflatable wedge-shaped envelopes have been proposed for effecting elevation of a patient above a fluidized surface. But such inflatable devices must be positioned beneath the head and chest of the patient before they can be inflated. This requires movement of the patient's head and chest in precisely the manner that the elevating inflatable devices are intended to effect. If such devices are predisposed beneath the patient, they detract from the therapeutic effect of the fluidized surface that otherwise would support the head and chest of the patient.

OBJECTS AND SUMMARY OF THE INVENTION

It is the principal object of the present invention to provide an apparatus for elevating at least a portion of a patient above a fluidized patient support surface.

Still another principal object of the prevent invention is to provide an apparatus for elevating at least a portion of a patient above a fluidized patient support surface, wherein the therapeutic effect of the fluidized surface is maintained beneath the portion of the patient to be elevated, at least until that portion of the patient undergoes elevation.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the patient elevating apparatus of the present invention comprises means for attaching the patient elevating apparatus to the fluidized support system, means for carrying the head and upper torso of the occupant of the fluidized support system, and means for pivoting one end of the carrying means above the fluidizable upper surface of the fluidized support system. The carrying means can be pivotally connected to the attaching means and pivotally connected to the pivoting means. Moreover, the attaching means can include means for pivotally connecting the carrying means to at least one side of the fluidized support system. Furthermore, the attaching means can also include means for connecting the pivoting means to at least one side of the fluidized support system.

As embodied herein, the attaching means can include a mounting bracket which is configured to be attached to a side of a fluidized support system. The mounting bracket can be in the form of a splice bar that defines an elongated main body with a first side and a second side. One of the sides of the main body defines an underside that is configured to be easily mounted to an upper side edge surface of the fluidized support system. A first mounting flange is provided to extend from the first side of the splice bar. A second mounting flange is provided to extend from the second side of the splice bar in a direction opposite to the direction in which the first mounting flange extends. The splice bar also defines an elongated slotted opening along a portion of the length of the main body of the mounting bracket. The slotted opening extends completely through the splice bar.

The mounting bracket also can include a shroud which attaches to the side of the fluidized support system. The shroud can define a pair of depending support flanges extending from a planar cover member. The upper free ends of the depending support flanges of the shroud can be attached to the opposite ends of each splice bar from the underside of the splice bar. A right angle bracket can join the lower free ends of each depending support flange and connect them to the side of the fluidized support system. A channel can be attached to the depending support flanges in the vicinity where they have their lower free ends joined to the right angle bracket and through an opening in the right angle bracket where the depending support flanges have their lower free ends joined to the right angle bracket and through an opening in the right angle bracket.

The carrying means can include a pair of splice bar linkages, one provided to be disposed on each opposite side of the fluidized support system. Each splice bar linkage defines a main body member, which in turn defines a first end and a second end disposed opposite to the first end. The main body member of each splice bar linkage defines an elongated slot through a portion of the main body member. This slot is configured with a first end and a second end disposed opposite to the first end. Each splice bar linkage further includes a lifting linkage in the form of a generally L-shaped flange. The shorter leg of the L-shaped flange defines a toe end portion near the vicinity of the free end of the shorter leg. The longer leg of the L-shaped flange defines a calf end portion in the vicinity of the free end of the longer leg. The L-shaped flange is pivotally mounted about a pivot post to the main body member of the splice bar linkage. The L-shaped flange extends through the elongated slot in a manner so that the calf end is exposed to one side of the slot while the toe end is disposed to the opposite side of the slot. The range of pivoting movement that is accorded to the L-shaped flange in the slot of the splice bar linkage is limited to a predetermined arcuate amount. An arc of about 15° provides a desirable range of pivoting movement for the L-shaped flange. The range of pivoting movement can be limited by providing a cam formed in each L-shaped flange and a cam follower disposed within the slot of each splice bar linkage. The cam follower is fixed and bounded by the cam and accordingly limits the range of movement of the splice bar linkage. Alternatively, the range of pivoting movement can be effected by configuring the L-shaped flange and the slot so that the opposite edges of the L-shaped flange butt against one of the ends of the slot when movement in that direction is to be arrested.

The carrying means also can include a lower support rod. The lower support rod has a semicircular arcuate portion disposed between two elongated straight portions. One of the elongated straight portions defines a first free end, while the opposite elongated straight portion defines a second free end. The lower support rod can be formed as a hollow metal tube or from another rigid material such as a hard plastic. Each free end of the lower support rod is pivotally connected to one of the sides of the fluidized support system via the first mounting flange of each splice bar disposed on opposite sides of the fluidized support system. Alternatively, the main body member of each splice bar linkage can be formed as part of a unitary structure with the lower support rod.

The carrying means also can include an upper support rod. The upper support rod defines a semicircular portion disposed between two straight portions. Each straight portion defines a free end of the upper support rod. Each free end of the upper support rod can be connected to the calf end of the lifting linkage of one of the splice bar linkages.

As embodied herein, the means for carrying the head and upper torso of the occupant of the fluidized support system can also include a flexible air permeable web. The web is configured to be carried by the upper support rod and the lower support rod, as by being draped completely around the two for example. The air permeable web is formed desirably of the same material as the filter sheet cover of the fluidized support system. It also is desirable to form the web as an integral part of the filter sheet cover of the fluidized support system. The end of the web disposed opposite to the end carried by the support rods is desirably anchored to the filter sheet cover. A sewn seam can be used to connect this end of the web to the filter sheet cover, and this seam should be disposed and configured so that it does not form a discomfort site for the occupant of the fluidized support system. The air permeable web is further configured so that upon the maximum separation between the upper support rod and the lower support rod during pivoting movement of the splice bar linkage, this separation being about 15°, the air permeable web becomes rendered taut for the purpose of carrying the head and upper torso of the occupant of the fluidized support system. In this taut configuration, the web forms a sling that carries the head and upper torso of the occupant and is capable of supporting same in an inclined position above the horizontal upper surface of the fluidized support system.

Means are provided for pivoting one end of the carrying means above the upper surface of the fluidized support system. As embodied herein, the pivoting means can include a pair of identical dual acting hydraulic cylinders having a cylinder member, a piston disposed within the cylinder member, and a piston rod connected to the piston and extending out of one end of the cylinder member. The piston separates the cylinder member into a first chamber and a second chamber. One dual acting hydraulic cylinder can be pivotally connected to each side of the fluidized support system via the second mounting flange for example. The opposite end of each hydraulic cylinder can be pivotally connected to the toe end of one of the lifting linkages which forms a part of the carrying means.

The means for pivoting the carrying means also can include a hydraulic fluid circuit for supplying hydraulic fluid under pressure to each of the dual acting hydraulic cylinders. The hydraulic circuit can include a hydraulic fluid pump, an electric motor which operates the pump, and a hydraulic fluid reservoir. The hydraulic circuit also can include a first channel connected via a first port to a first hydraulic conduit line that leads to the first chambers of the hydraulic cylinders. The hydraulic circuit further can include a second channel connected via a second port to a second hydraulic conduit line that leads to the second chambers of the hydraulic cylinders. The hydraulic circuit can include a directional control valve that determines whether the pump is connected to one or the other of the chambers of each dual acting hydraulic cylinder. The hydraulic circuit can include a pair of cross port relief valves that can be mechanically (or electronically, with an appropriate type valve) set for a predetermined breakdown pressure at which each valve permits flow to pass through it. Each relief valve is configured, disposed, and set with a breakdown pressure so that the pressure within the hydraulic fluid circuit cannot exceed the preset pressure desired in each channel of the hydraulic circuit.

The hydraulic circuit further includes a pair of pressure compensated flow control valves. Each pressure compensated flow control valve has a check valve branch and a flow control branch. The check valve branch prevents flow in one direction and provides essentially no resistance to flow in the opposite direction. The flow control branch can be mechanically (or electronically, with an appropriate type valve) set to permit a preset rate of flow through it, regardless of the pressure of the fluid flowing through this branch. The pressure compensated flow control valves are used to control the rate of hydraulic fluid flowing through the hydraulic circuit and so control the speed of movement of the pistons of the dual acting hydraulic cylinders. Accordingly, the flow control valves also control the speed of movement of the web and the support rods during the pivoting of same to and from the upper surface of the fluidized support system.

In accordance with the present invention, a means is provided for protecting against doing damage to an obstacle which may become interposed in the path of the carrying means as the carrying means is being lowered toward the surface of the fluidized support system. As embodied herein, the interposed obstacle damage avoidance means can include a reversing means that reverses the lowering direction of the carrying means so that the carrying means begins raising away from the surface of the fluidized support system and also away from the object that is causing the resistance. As embodied herein, the reversing means can include a pressure sensor, a means for detecting the location of each piston within the cylinder member of each dual acting hydraulic cylinder, and an electrical relay. The pressure sensor can include a pressure switch disposed to monitor the pressure in the hydraulic circuit. The pressure switch can be a normally open switch that is adjustably set to close upon the attainment of a certain threshold pressure in the hydraulic circuit. The threshold pressure would be set at a pressure of about 25% above the maximum pressure that would be expected in the hydraulic circuit during lowering of the carrying means without encountering any obstacle.

As embodied herein, the means for detecting the location of each piston can include a magnetic member attached to or defining each piston. The piston position sensing means also can include a normally closed magnetic reed switch associated with each cylinder member so that the switch opens when the piston reaches the position within each cylinder member that corresponds to the completion of the normal lowering of the carrying means to the rest position, i.e. a fully lowered position.

A relay is provided and is electrically connected to provide electrical power from a power source to activate the directional control valve and the motor which operates the pump. The pressure switch is disposed electrically to connect each magnetic reed switch to the electrical relay. When the pressure switch detects the threshold pressure, and the pistons have not become disposed in their fully lowered positions, this indicates the presence of an obstacle in the path of the carrying means. When this occurs, electric power is provided to open the relay, which electrically disconnects the power source from the solenoid of the directional control valve and from the motor, thus causing the carrying means to reverse its direction from a lowering direction to a raising direction and thence to cease movement altogether.

In an alternative embodiment of the interposed obstacle damage avoidance means, the hydraulic circuit is configured so that when the carrying means is lowering the web toward the surface of the fluidized support system and meets resistance, a relief valve acts so as to relieve sufficient pressure in the hydraulic circuit to prevent the carrying means from applying more than a nominal amount of force against the resistance, and then only applying this nominal force for a very brief time.

The hydraulic circuit also can include a two-way valve disposed between the pump and the hydraulic cylinders to selectively permit or prevent communication between the hydraulic cylinders on the one hand and the pump and hydraulic reservoir on the other hand.

The hydraulic circuit also can include a CPR dump valve in the form of a one-way solenoid valve. The CPR dump valve is disposed between the hydraulic cylinders and the hydraulic fluid reservoir in a manner that by-passes the pressure relief valves, the two-way valve, and the pressure compensated flow control valves. Activation of the CPR dump valve drains the hydraulic fluid from the chambers of the hydraulic cylinders responsible for maintaining the support rods in an inclined position above the horizontal surface of the fluidized support system.

The hydraulic circuit also can include a manually operated CPR dump valve. The manual dump valve is configured and disposed so as to bypass both pressure relief valves, both pressure compensated flow control valves, the one way solenoid valve, and the two-way solenoid valve. The manual dump valve is disposed in the hydraulic circuit so that it can be activated to provide communication between the hydraulic fluid reservoir and the chambers of the hydraulic cylinders responsible for maintaining the support rod in a position inclined above the horizontal surface of the fluidized support system. So disposed, the manual dump valve can be used to lower the support rods under conditions in which electrical power becomes unavailable to activate the solenoid valves of the apparatus of the present invention.

As embodied herein, the channel component of the mounting bracket cooperates with the depending support flanges of the mounting bracket to provide support for the first and second hydraulic conduit lines that carry hydraulic fluid to and from the chambers of the dual acting hydraulic cylinders.

Means are provided to shield the occupant of the fluidized patient support system from the moving mechanical parts of the apparatus of the present invention. As embodied herein, the shielding means can include a pair of flexible bellows. Each flexible bellows is configured with a pleated expandable portion, which expands and contracts so as to accommodate the pivoting movement of the splice bar linkage housed within each flexible bellows. Moreover, the lower edges of each bellows are configured to engage the periphery of the filter cover sheet of the fluidized support system and hold it in the same fashion as the rubber extrusion that attaches the periphery of the filter cover sheet to the upper edge of the tank that holds the fluidizable material.

As embodied herein, each of the support rods is covered with a cylindrical sheath of high density foam or rubber material. The sheath of cushioning material surrounding the support rods defines a smooth outer surface that permits the flexible web to glide in an unencumbered fashion when separation occurs between the two support rods and the flexible web is rendered taut.

As embodied herein, the electrical activation of the hydraulic pump and the various solenoid valves used to effect pivoting of the support rods is configured so that the fluidization of the mass of fluidizable material is discontinued as the support rods begin pivoting above the surface of the fluidized support system. This provides a firm surface beneath the occupant of the fluidized support system during elevation of the head and upper torso of the occupant above this surface. This firm surface prevents the occupant from sliding in response to the horizontal forces created by the inclining of the head and upper torso of the occupant. Similarly, when the elevated web is being rapidly lowered to the surface of the fluidized support system, the mass of fluidizable material is desirably defluidized either prior to or during the step of rapidly lowering the web to the surface of the fluidized support system. In this way, by the time the occupant is restored to a level position on the upper surface of the fluidized support system, this upper surface has become firm enough to enable the attendants to perform a CPR or other emergency procedure upon the occupant.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the present preferred embodiments of the present invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

Figure 1:
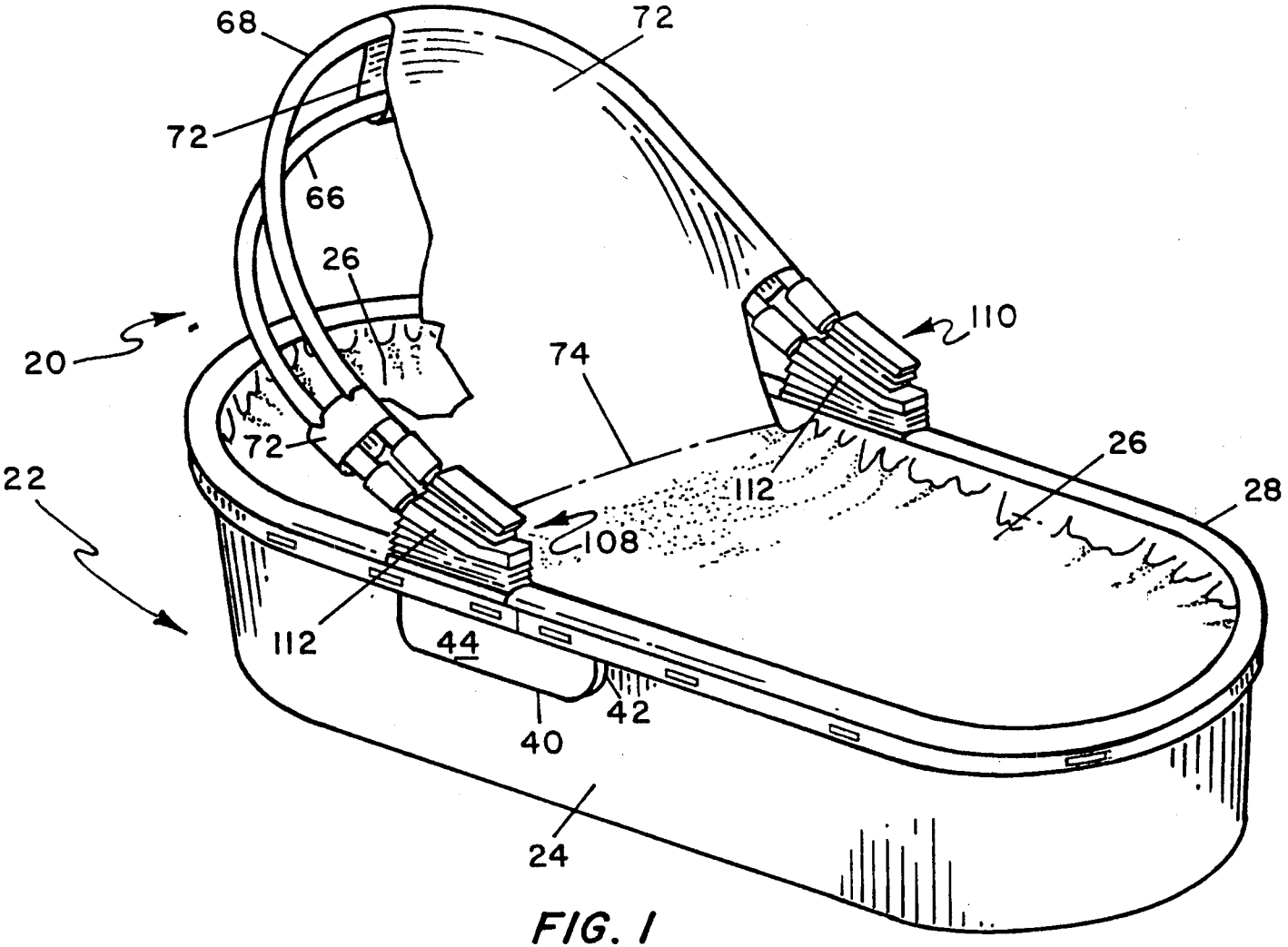
FIG. 1 is a schematic illustration of an elevated perspective view of a preferred embodiment of the apparatus of the present invention with the flexible web component cut-away to reveal the underlying upper and lower support rods.

A preferred embodiment of the apparatus of the present invention for inclining or elevating the patient in a fluidized patient support system is shown in FIG. 1 and is represented generally by the numeral 20. For the sake of simplifying the drawings, FIG. 1 shows only a simplified version of a fluidized patient support system (generally indicated in FIG. 1 by the designating numeral 22) to which the present invention has been attached. The fluidized patient support system includes a rigid tank 24 containing the fluidizable mass of material (not shown), a cover sheet 26 resting atop the fluidizable material, a flexible extrusion 28 that clamps the periphery of cover sheet 26 to the upper edge of tank 24.

In accordance with the present invention, means are provided for attaching the inclining apparatus of the present invention to a fluidized support system. The attaching means can include a mounting bracket, which as embodied herein and shown in FIG. 2 for example can be defined at least partially in the form of a splice bar 30. Desirably, a pair of mounting brackets are provided, one for each opposite side of the fluidized support system. Each mounting bracket is configured to be attached to a side of a fluidized support system. Fastening means, such as threaded bolts and threaded nuts for example, also can be provided to attach each mounting bracket to the side of the fluidized support system.

Figure 2:
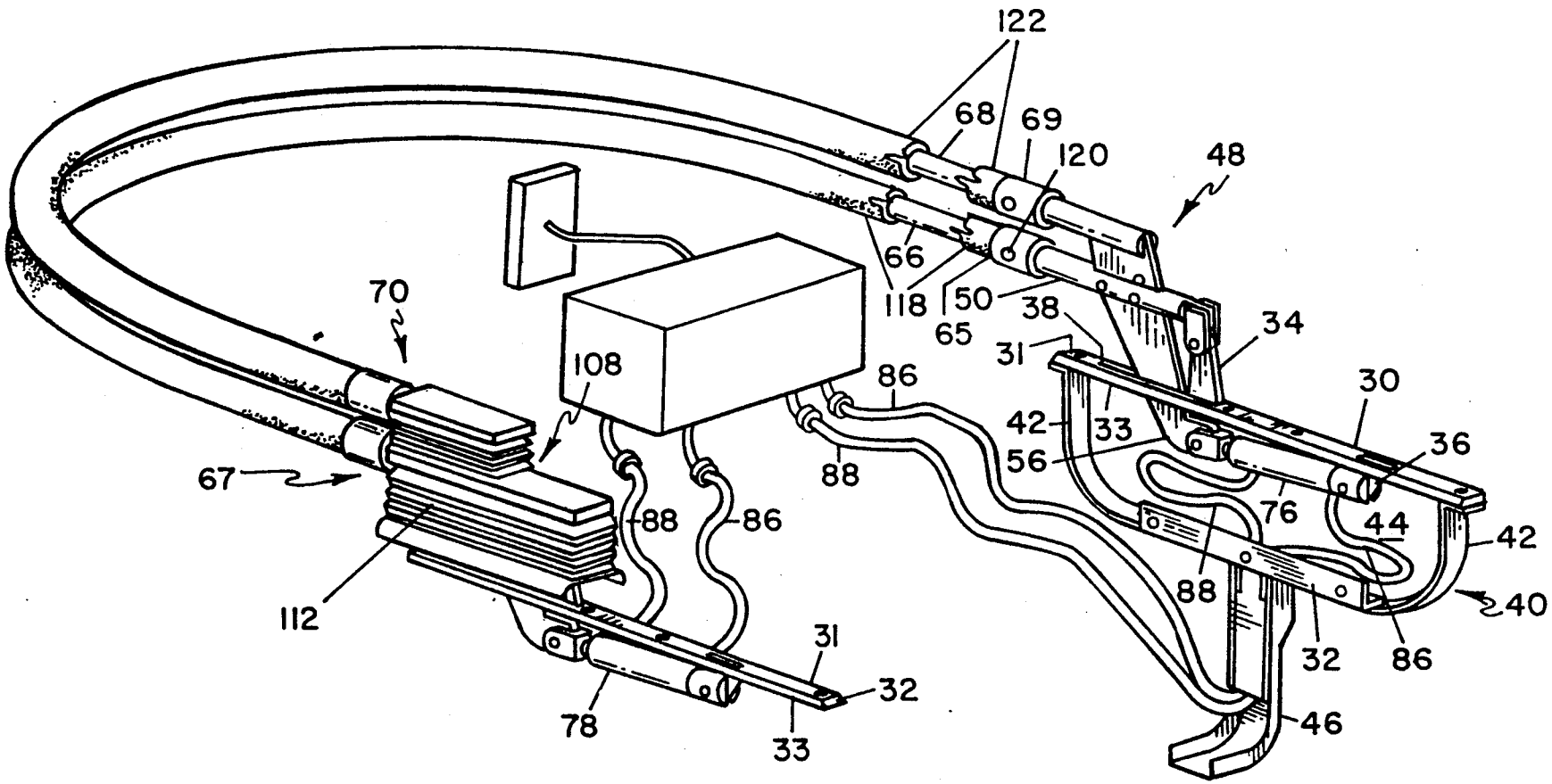
FIG. 2 is schematic representation of an elevated perspective view of components of a preferred embodiment of the apparatus of the present invention.

As embodied herein and shown in FIG. 2 for example, each splice bar 30 is configured to extend along the length of a side portion of the fluidized support system. Each splice bar 30 defines an elongated main body having a first side 31 and a second side 33 disposed opposite to the first side. One of the first and second sides of the main body defines an underside configured to be easily mounted to an upper side edge surface of the fluidized support system. Each splice bar 30 can be attached, as by mechanical fastening means such as rivets or threaded nuts and bolts for example, to an existing surface of the fluidized support system.

As embodied herein and shown in FIGS. 2–5, 6A and 6B for example, each mounting bracket defines a first mounting flange 34 extending from first side 31 of splice bar 30. Each mounting bracket also defines a second mounting flange 36 extending from second side 33 of splice bar 30. Thus, first mounting flange 34 extends from splice bar 30 in a direction opposite to the direction in which second mounting flange 36 extends.

As embodied herein and shown in FIG. 2–5, 6A and 6B for example, each splice bar 30 defines an elongated slotted opening 38 along a portion of the length of the main body of the mounting bracket. The dashed lines in FIGS. 6A and 6B define the ends of slotted opening 38. Slotted opening 38 extends completely through the main body of the mounting bracket and connects first side 31 of splice bar 30 to second side 33 of splice bar 30.

As further embodied herein and shown in FIGS. 1 and 2 for example, each mounting bracket can include a shroud 40, which can be attached to the side of tank 24 and defines a pair of depending support flanges 42 extending from a planar cover member 44. Desirably shroud 40 can be formed of plastic material, yet any lightweight strong material such as sheet metal will suffice. The upper free ends of the depending support flanges 42 are attached to opposite ends of each splice bar 30 and extend from underside 33 of splice bar 30. A right angle bracket 32 joins the lower free ends of each depending support flange 42 and connects same to the side of tank 24 of the existing fluidized support system. As shown in FIG. 2 for example, a channel 46 is attached to the depending support flanges 42 in the vicinity where they have their lower free ends joined to right angle bracket 32 and through an opening (not shown) in right angle bracket 32.

As embodied herein, the means for attaching the apparatus to the fluidized support system can include means for pivotally connecting the carrying means to at least one side of the fluidized support system. In addition, the attaching means also can include means for connecting the pivoting means to at least one side of the fluidized support system. Such connecting means can include mechanical fastening means such as screws, and/or threaded nuts, and/or threaded bolts, and/or rivets. Desirably, threaded bolts and threaded nuts are used, especially in embodiments of the present invention intended to be used to retrofit already existing fluidized support systems.

As described above, the means for attaching the patient elevation apparatus of the present invention to the fluidized support system facilitates retrofitting a fluidized support system with the apparatus of the present invention. Alternatively, the attaching means described above also can be provided as an integral part of the original equipment of a fluidized support system, as will be apparent to the reader.

In further accordance with the present invention, means are provided for carrying the head and upper torso of the occupant of the fluidized support system. The carrying means is desirably pivotally connected to the attaching means, but also can be pivotally connected directly to the fluidized support system itself. As embodied herein and shown in FIGS. 2-5, 6A and 6B for example, the carrying means can include a first splice bar linkage indicated generally by the designating numeral 48. A second splice bar linkage is provided on the opposite side of the apparatus. The first and second splice bar linkages are essentially identical in all operative respects, and so this discussion will refer only to first splice bar linkage 48 in order to avoid duplication. As shown in FIGS. 6A and 6B for example, first splice bar linkage 48 defines a main body member 50, and the main body member defines a first end 49 and a second end 51 that is disposed opposite the first end. As shown in dashed lines in FIGS. 6A and 6B for example, main body member 50 of first splice bar linkage 48 defines an elongated slot 52 through a portion of the main body member. The slot 52 defined through the main body member is configured with a first end 53 and a second end 55 disposed opposite to the first end.

As embodied herein and shown in FIGS. 6A and 6B for example, first splice bar linkage 48 further includes a first lifting linkage in the form of a generally L-shaped flange 54. The shorter leg of L-shaped flange 54 defines a toe end portion 56 near the vicinity of the free end of the shorter leg. The vicinity of the free end of the longer leg of L-shaped flange 54 defines a calf end portion 58. L-shaped flange 54 is pivotally mounted about a pivot post 60 to main body member 50 of splice bar linkage 48. L-shaped flange 54 extends through elongated slot 52 so that calf end 58 is exposed to one side of slot 52 and toe end 56 is disposed to the opposite side of slot 52.

Each slot 52 and each L-shaped flange 54 is configured so that the lifting linkage pivotally mounted in slot 52 has a range of pivoting movement that is limited to a predetermined arcuate amount. Desirably, an arc of about 15° provides the range of pivoting movement of L-shaped flange 54. In one embodiment, such as shown in FIGS. 6A and 6B for example, the limitation in the range of pivoting movement of first splice bar linkage 48 occurs when a cam 62 formed in each L-shaped flange 54 engages a cam follower 64 disposed within slot 52 of splice bar linkage 48. The cam follower is fixed and bounded by cam 62 and so limits the range of movement of the splice bar linkage. Moreover, the shape of cam 62 defines an arc with a radius of curvature equal to the distance between cam follower 64 and pivot post 60 about which L-shaped flange 54 pivots. Furthermore, the cam could be defined along an edge of L-shaped flange 54 rather than in the interior of same (as shown in FIGS. 6A & 6B for example), as desired. In another embodiment (not shown), the limitation in the range of pivoting movement occurs when the edge 57 of L-shaped flange 54 butts against first end 53 of slot 52.

The carrying means can further include a lower support rod. As embodied herein and shown in FIG. 2 for example, a lower support rod 66 has a semicircular arcuate portion disposed between two elongated straight portions. One of the elongated straight portions defines a first free end 65, while the opposite elongated straight portion defines a second free end 67. First end 65 of lower support rod 66 is pivotally connected to a first side of the fluidized support system via first mounting flange 34 of splice bar 30. Similarly, the second end of lower support 66 rod is pivotally connected to the second side of the support system via an identical first mounting flange of an identical mounting bracket. In some embodiments, main body member 50 of splice bar linkage 48 can be formed as part of a unitary structure with lower support rod 66. However, for ease of assembly, main body member 50 can define a detachable structure which can be connected at a distal end (not shown) to a cavity (not shown) defined in one of the ends of lower support rod 66, which can be defined as a hollow metal tubular member. In either event, lifting linkage 54 becomes pivotally connected to lower support rod 66 via pivot post 60 in slot 52.

The carrying means can further include an upper support rod. As embodied herein and shown in FIG. 2 for example, an upper support rod 68 has a semicircular arcuate portion disposed between two elongated straight portions. One of the elongated straight portions defines a first free end 69, while the opposite elongated straight portion defines a second free end 70. Upper support rod 68 can be defined as a hollow metal tubular member. As shown in FIGS. 6A and 6B for example, first end 69 of upper support rod 68 is connected to calf end 58 of first lifting linkage 54. Though not expressly illustrated in detail in the FIGS., as indicated in FIGS. 2-5 for example, the second end of upper support rod 68 is connected to a similar calf end of a second lifting linkage.

As embodied herein and shown in FIG. 1 for example, the means for carrying the head and upper torso of the occupant of the fluidized support system can further include a flexible air permeable web 72 (shown partially broken away in FIG. 1). Air permeable web 72 is configured to be carried by upper support rod 68 and lower support rod 66. Air permeable web 72 is formed preferably of the same material as the filter sheet cover 26 of the fluidized support system and desirably is formed as an integral part of the filter sheet cover of the fluidized support system. The end of the web opposite the end carried by the support rods is desirably anchored as by being sewn to the filter sheet cover that forms the upper surface of the fluidized support system and carries the occupant of the system. The seam 74 connecting web 72 and cover 26 should be disposed and configured so that it does not form a discomfort site for the occupant of the fluidized support system. Moreover, air permeable web 72 is configured so that upon the maximum separation between upper support rod 68 and lower support rod 66, air permeable web 72 becomes rendered taut for the purpose of carrying the occupant of the fluidized support system. Air permeable web 72 becomes taut enough to form a sort of sling that carries the head and upper torso of the occupant and is capable of supporting same in an inclined position as shall be described below.

In still further accordance with the present invention, means are provided for pivoting one end of the carrying means above the fluidized upper surface of the fluidized support system. As embodied herein and shown in FIGS. 2-5, 6A and 6B for example, the pivoting means can include a pair of identical dual acting hydraulic cylinders 76, 78. An example of a suitable dual acting hydraulic cylinder has a one inch diameter cylinder bore, a four inch maximum stroke, and a maximum pressure rating of about 1200 psi. The area of the cylinder piston on the side (rod end) attached to the piston rod is 0.589 square inches, and the area of the opposite side (blind end) of the piston is 0.785 square inches. A first dual acting hydraulic cylinder 76 can be connected to one side of the fluidized support system, while a second dual acting hydraulic cylinder 78 can be connected to the opposite side of the fluidized support system. As shown in FIGS. 6A and 6B for example, each dual acting hydraulic cylinder 76 has a first one of its ends configured for pivotally connecting to a first side of the fluidized support system via second mounting flange 36. As shown in FIGS. 2, 6A and 6B for example, each dual acting hydraulic cylinder has a second one of its ends pivotally connected to the toe end 56 of a lifting linkage 54. Thus, one of the ends of the dual acting hydraulic cylinder is pivotally connected to the side of the fluidized support system, while the other end is pivotally connected to toe end of lifting linkage 54, which forms a part of the carrying means.

Figure 8:
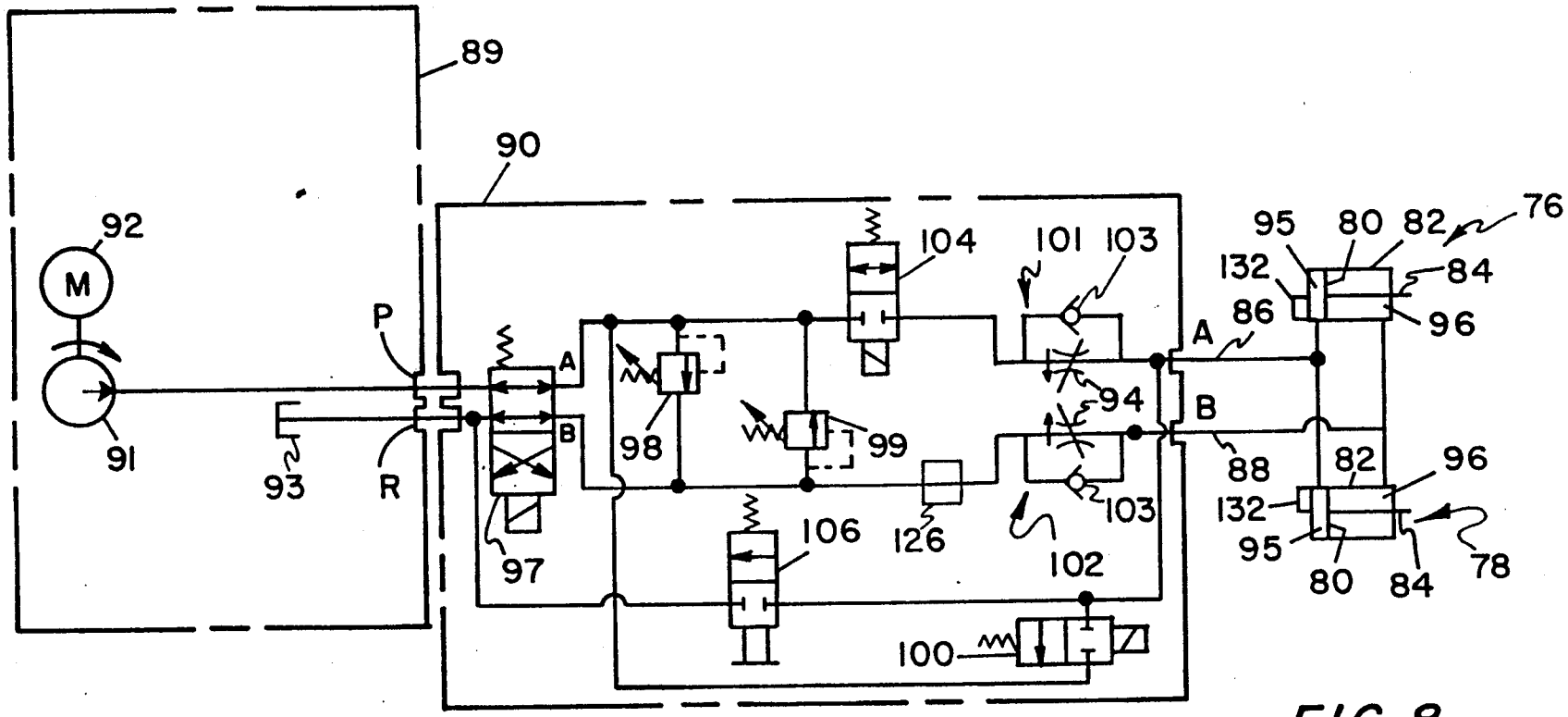
FIG. 8 illustrates a schematic diagram of components of a preferred embodiment of the apparatus of the present invention.

As shown schematically in FIG. 8 for example, each dual acting hydraulic cylinder 76, 78 includes a piston 80 which is hydraulically connected and confined within a pressure resistant piston casing cylinder member 82. As shown in FIGS. 6A, 6B and 8 for example, the end of dual acting hydraulic cylinder 76 connected to toe end 56 of lifting linkage 54 is an end connected to piston 80 via a piston rod 84. The end of piston casing cylinder member 82 is pivotally connected to second mounting bracket flange 36. Thus, second mounting bracket flange 36 is pivotally connected to the pivoting means. Each lifting flange 54 constitutes the portion of the carrying means that extends from the first side of the mounting bracket 30 through the slotted opening 38 in the mounting bracket and pivotally connects to the elevating means on the second side of the mounting bracket. Moreover, in this way, the pivoting means is pivotally connected to the carrying means.

Figure 3:
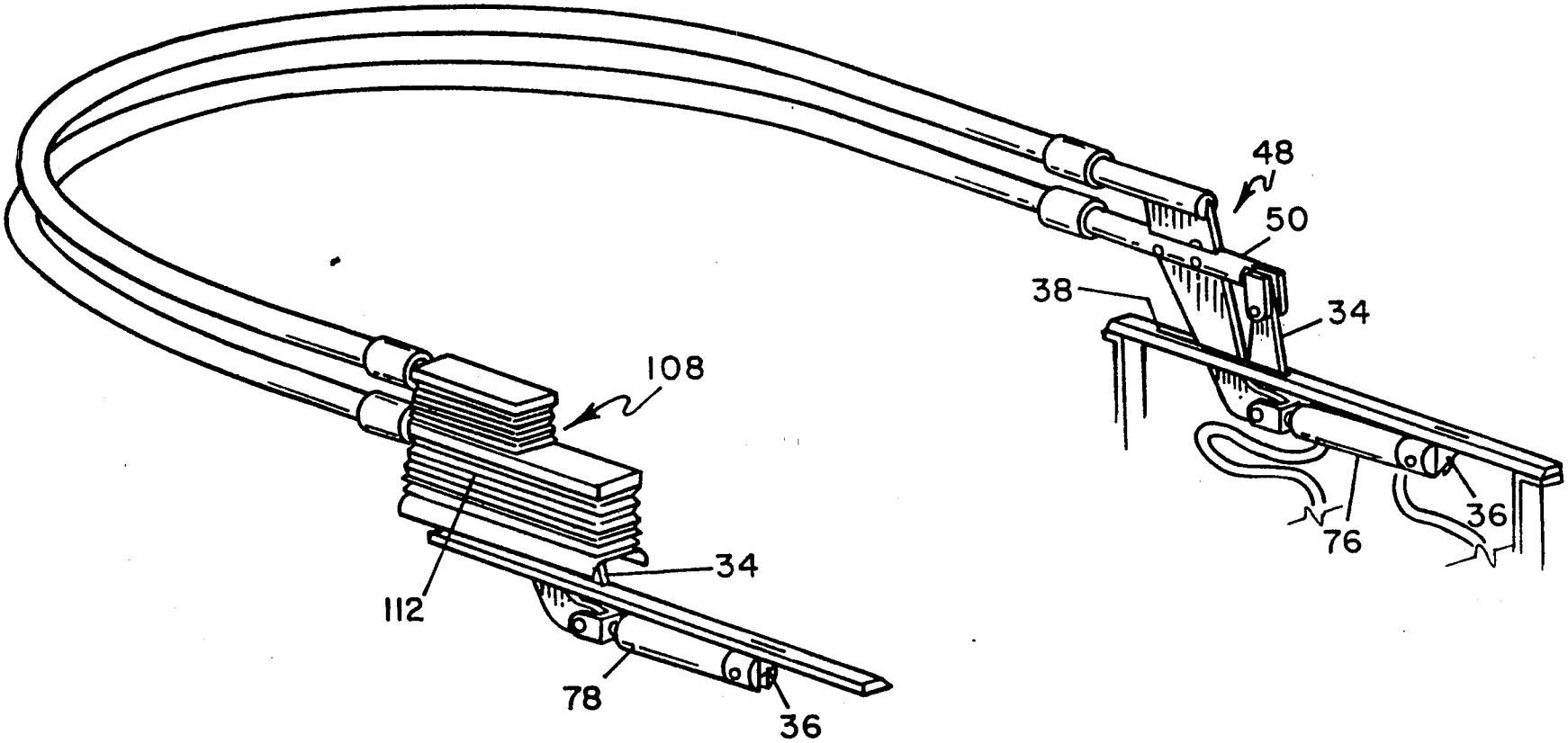
FIG. 3 is a schematic representation of an elevated perspective view of components of a preferred embodiment of the apparatus of the present invention.
Figure 4:
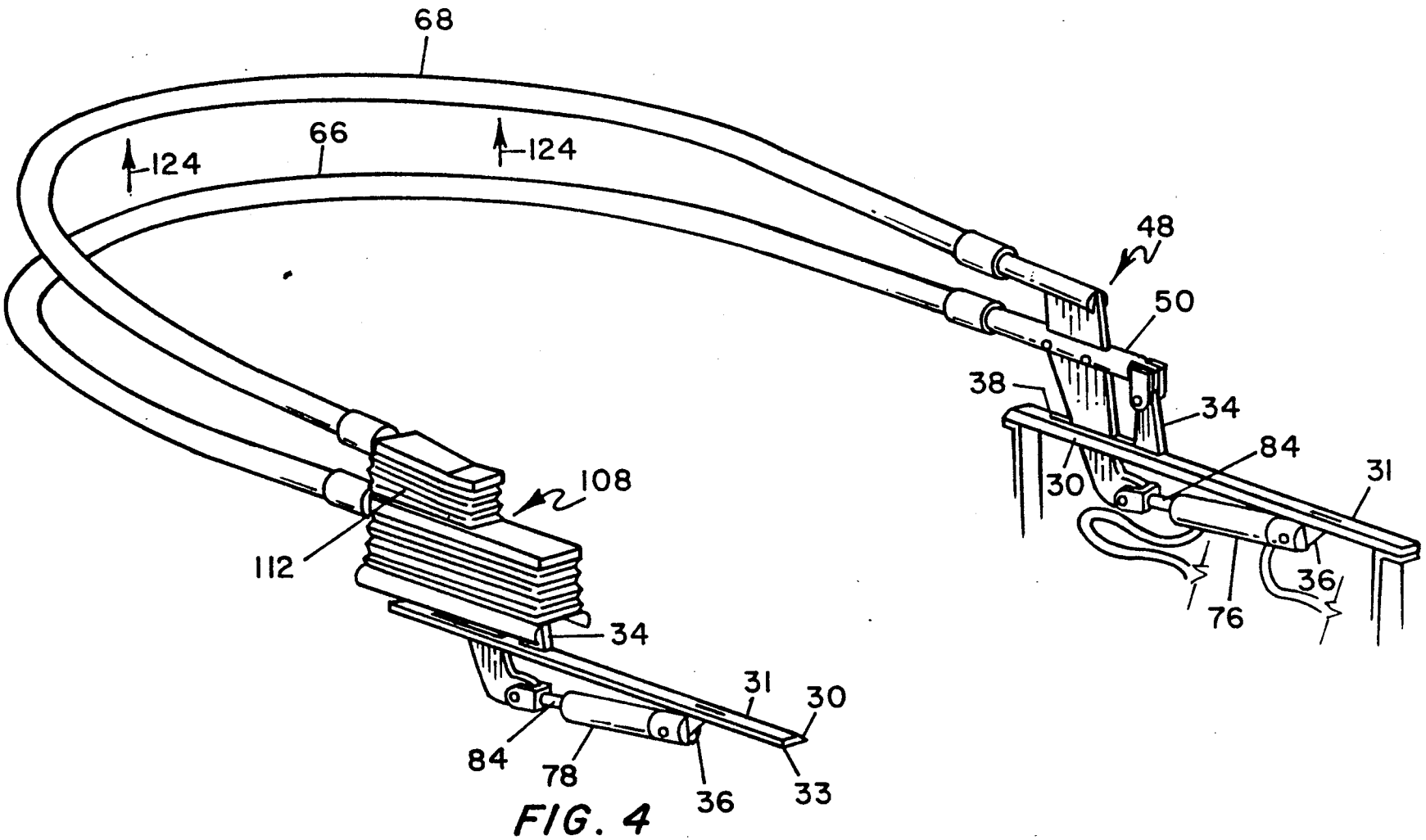
FIG. 4 is a schematic representation of an elevated perspective view of components of a preferred embodiment of the apparatus of the present invention.
Figure 5:
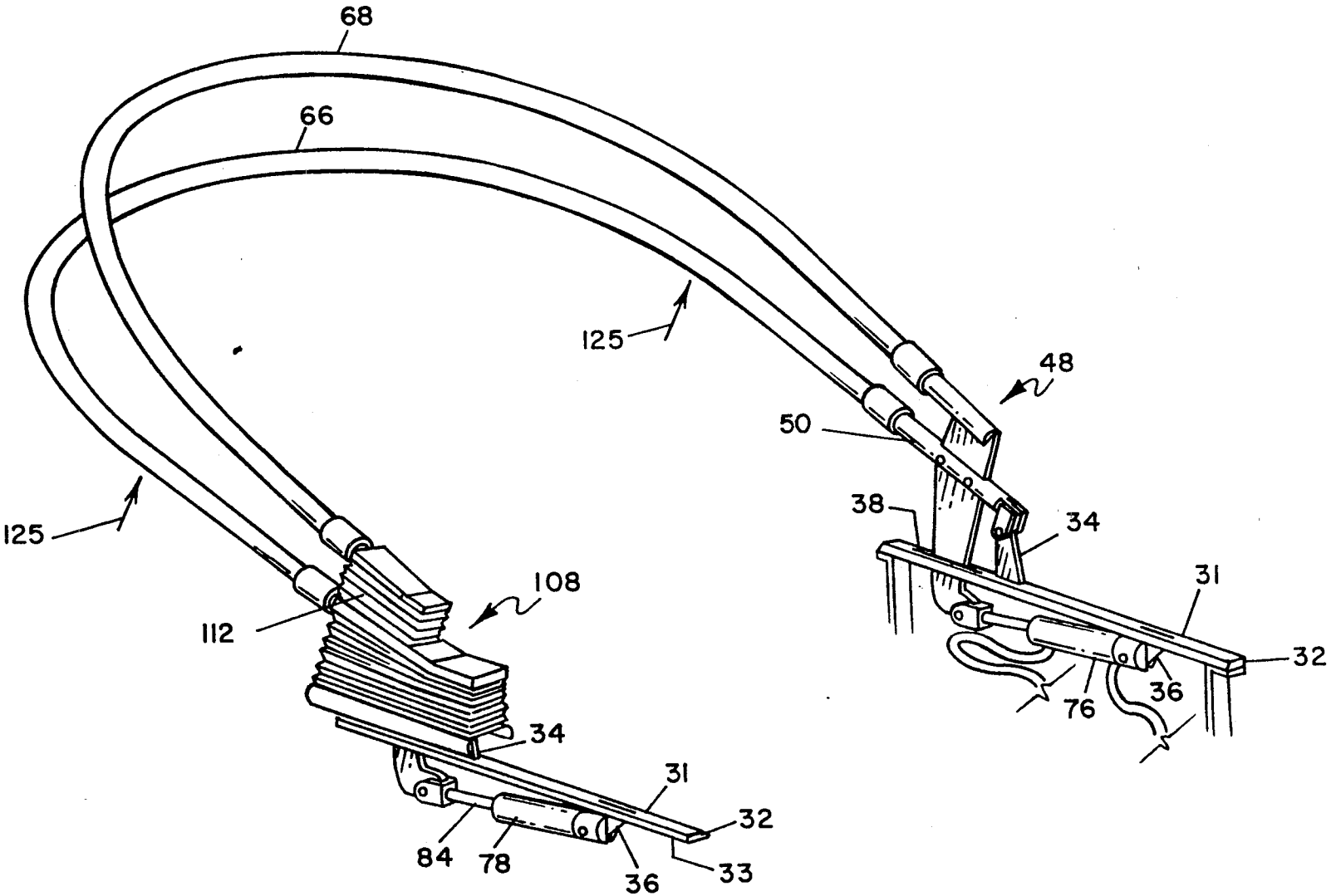
FIG. 5 is a schematic representation of an elevated perspective view of components of a preferred embodiment of the apparatus of the present invention.
Figure 6A:
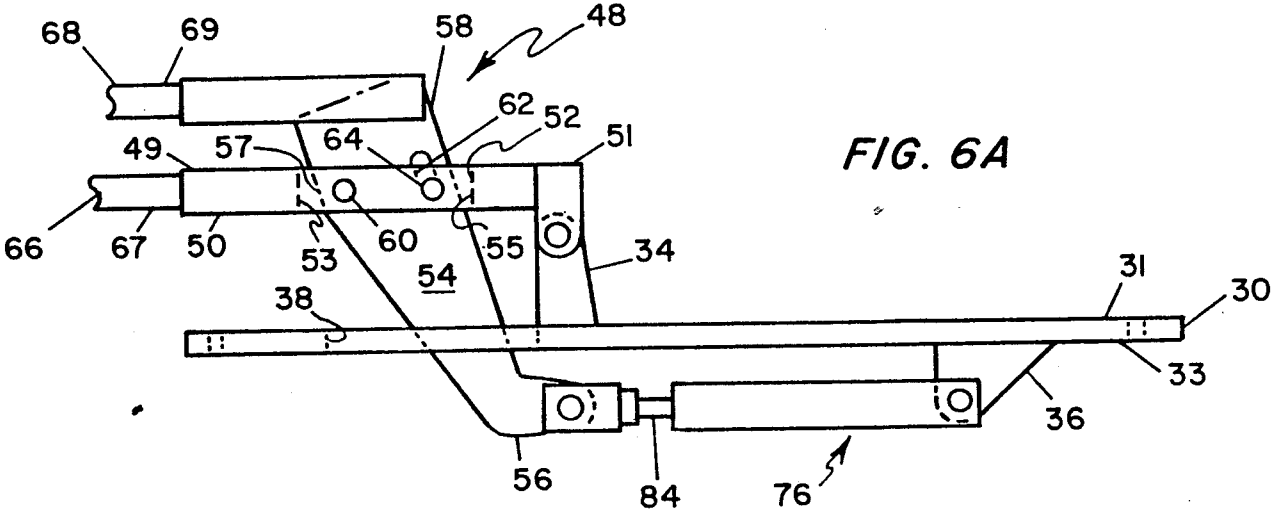
FIG. 6A illustrates a side plan view of components of a preferred embodiment of the apparatus of the present invention.
Figure 6B:
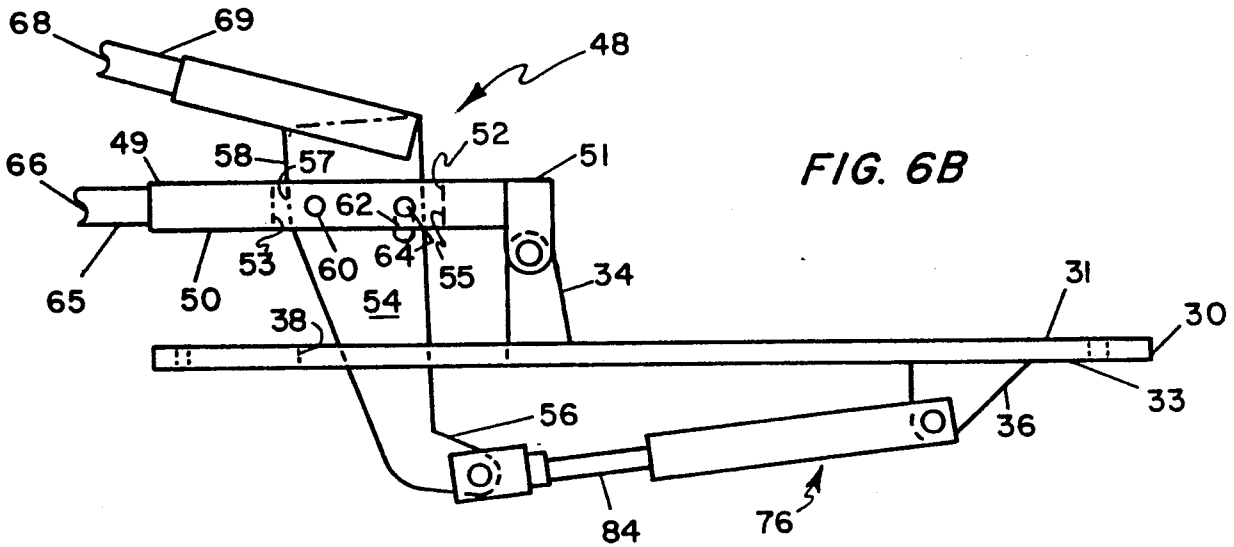
FIG. 6B illustrates a side plan view of components of a preferred embodiment of the apparatus of the present invention.

Referring to FIGS. 3-5, 6A and 6B, splice bar linkages 48 are configured and mounted to splice bar 30 so that the initial length of travel of piston rods 84 out of hydraulic cylinder 76, 78 causes pivoting of L-shaped flange 54 about pivot post 60. Consequently, pivoting of calf end portion 58 of L-shaped flange 54 about pivot post 60 produces as much as a 15 degree separation between upper support rod 68 and lower support rod 66. This separation between support rods 66 and 68 continues until cam 62 rests against cam follower 64 as shown in FIG. 6B for example. This is indicated in FIG. 4 by the arrows designated 124. Once this positioning of cam 62 and cam follower 64 has been attained as shown in FIG. 6B for example, further extension of piston rods 84 acts to lift lower support rod 66 in a movement that pivots about first mounting flange 34. This movement is shown in FIG. 5 for example and is indicated by arrows designated 125.

In further accordance with the present invention, the means for pivoting the carrying means can include a hydraulic fluid circuit for supplying hydraulic fluid under pressure to each of the first and second dual acting hydraulic cylinders. As embodied herein and shown in FIGS. 2 and 8 for example, a first hydraulic conduit line 86 and a second hydraulic conduit line 88 carry hydraulic fluid for first dual acting hydraulic cylinder 76 and for second dual acting hydraulic cylinder 78. As embodied herein and shown schematically in FIG. 8 for example, each of first and second conduit lines 86, 88 forms part of a larger hydraulic fluid circuit indicated within a first rectangular dashed line perimeter 89 and a second rectangular dashed line perimeter 90. First hydraulic conduit line 86 is connected to the portion of the hydraulic circuit designated 90 via a port designated A in FIG. 8. Similarly, second hydraulic conduit line 88 is connected to the portion of the hydraulic circuit designated 90 via a port designated B in FIG. 8. First hydraulic conduit line 86 and second hydraulic conduit line 88 are connected to the portion of the hydraulic circuit designated 89 via the portion of the hydraulic circuit designated 90.

As embodied herein and shown schematically in FIG. 8 for example, the portion of the hydraulic circuit designated 89 includes a hydraulic fluid pump 91, an electric motor 92 which operates pump 91, and a hydraulic fluid reservoir 93 containing about 0.2 gallons of hydraulic fluid. A suitable electric motor is a one third horsepower, 60 Hz, 120 volts, A/C, permanent split capacitor style motor, which is a capacitor start-/capacitor run style motor. A suitable hydraulic fluid pump is a positive displacement, single direction rotation pump having a maximum rated pumping capacity of about 0.3 gallons of hydraulic fluid per minute at a pressure of about 500 psi.

In FIG. 8, first dual acting hydraulic cylinder 76 is represented schematically as a first cylinder chamber 95 and a second cylinder chamber 96 separated by a piston 80. First hydraulic conduit line 86 supplies hydraulic fluid to first cylinder chamber 95, and second hydraulic conduit line 88 supplies hydraulic fluid to second cylinder chamber 96. Thus, when hydraulic fluid under higher pressure is applied through first hydraulic conduit line 86 to first chamber 95 of first dual acting hydraulic cylinder 76 than is applied through second hydraulic conduit line 88 to second chamber 96 of first dual acting hydraulic cylinder 76, then piston rod 84 extends from within cylinder member 82. Similarly, when pressure is relatively increased in second hydraulic conduit line 88, pressure is increased in second chamber 96 of cylinder member 82 and piston rod 84 retracts within cylinder member 82. This same conventional hydraulic dual acting cylinder operation applies to second dual acting hydraulic cylinder 78.

In further accordance with the present invention, hydraulic circuit 90 includes a directional control valve 97, a first cross port relief valve 98, a second cross port relief valve 99, a one-way CPR dump valve 100, a first pressure compensated flow control valve 101, a second pressure compensated flow control valve 102, a two-way valve 104, and a manually operated CPR dump valve 106. As shown schematically in FIG. 8, the valves in circuit 90 are connected in a configuration that has two parallel channels, namely, channel A and channel B. Channel A extends between port A and port P, while channel B extends between port B and port R and generally parallel to channel A. As shown schematically in FIG. 8 in its activated configuration, directional control valve 97 is a basic 4-way, 2-position valve that is solenoid actuated and has a spring return. As shown schematically in FIG. 8 in its inactivated, i.e., load holding, configuration, two-way valve 104 is a spring return solenoid valve. As shown schematically in FIG. 8 in its inactivated, i.e., load holding, configuration, one-way valve 100 is a spring return, solenoid valve. Each of the solenoid valves can be electrically activated. Desirably, the electrical activation of the solenoid valves is controlled by a portable manually held unit (not shown) containing suitable electric switches for raising, lowering, and stopping the inclination of the support rods, as well as switches for activating the CPR dump valve 100. Alternatively, the valves can be of the electronically dynamic variety, and thus could be controlled by a preprogrammed microprocessor unit.

First cross port relief valve 98 has a "breakdown" pressure threshold that must be met before valve 98 becomes activated to permit flow (from channel A to channel B in the configuration schematically shown in FIG. 8). Similarly, second cross port relief valve 99 has a "breakdown" pressure threshold that must be met before valve 99 becomes activated to permit flow (from channel B to channel A in the configuration schematically shown in FIG. 8). The breakdown thresholds of relief valves 98, 99 are variable and can be set mechanically. In the configuration of hydraulic circuit 90, first relief valve 98 is set at the maximum pressure deemed necessary to power hydraulic cylinders 76, 78 to lift support rods 66, 68, web 72 and the head and torso of the patient of maximum anticipated weight above the upper surface of the fluidized support system. Second relief valve 99 is set at the pressure deemed necessary to overcome the pressure losses associated with the hydraulic circuit and provide sufficient flow of hydraulic fluid through first pressure compensated flow control valve 101 to drain first chamber 95 of hydraulic fluid at the rate needed to produce the desired speed at which the support rods 66, 68 are to be lowered toward the surface of the fluidized support system. With the one inch bore hydraulic cylinders 76, 78 described above, the preset pressure for first relief valve 98 typically can be set at about 300 psi, while the preset pressure for second relief valve 99 typically can be set at about 25 psi.

As shown schematically in FIG. 8, each pressure compensated flow control valve 101, 102 has a check valve 103 in one branch and a pressure compensated variable flow control 94 in a second branch. The check valve branch prevents flow in one direction and provides almost no resistance to flow in the opposite direction. The pressure compensated variable flow branch restricts the flow through it to a preset rate of flow, regardless of the pressure of the fluid entering this branch. The flow settings of the pressure compensated flow control valves 101, 102 are variable and can be set mechanically. With the one inch bore hydraulic cylinders 76, 78 described above, the flow setting of each pressure compensated flow control valve 101, 102 typically can be set at about 0.1 gallons per minute (0.385 cubic feet per minute).

Reference now will be made to FIG. 8 in describing the expansion (extending piston rod 84 out of cylinder member 82) and then the contraction (withdrawing piston rod 84 into cylinder member 82) of the dual acting hydraulic cylinders. When it is desired to expand the dual acting hydraulic cylinders 76, 78, control valve 97 is activated, and thus configured so that the paths schematically indicated by the parallel arrows connect circuit 90 and circuit 89. Simultaneous with activation of control valve 97, two-way solenoid valve 104 also is activated so as to permit flow from pump 91 through the check valve branch of pressure compensated flow control valve 101, out of port A and into first chambers 95 via first conduit line 86. In reaction to fluid entering first chambers 95 under pressure provided by pump 91, pistons 80 move so that piston rods 84 extend farther out of cylinder members 82 and push hydraulic fluid out of second chambers 96 of hydraulic cylinder members 76, 78. However, the pressure compensated flow control branch of second pressure compensated flow control valve 102 is set to permit only a predetermined rate (0.1 gal./min. for example) of hydraulic fluid flow. This predetermined rate is set so as to enable second pressure compensated flow control valve 102 to control the speed at which pistons 80, and accordingly support rods 66, 68, move and thus controls the speed at which the patient's head and upper torso are raised above the upper surface of the fluidized support system. Because pump 91 continues to operate, pressure in excess of the preset level of first pressure relief valve 98 causes hydraulic fluid to flow from channel A through first pressure relief valve 98 and into channel B, where the fluid returns via port R to reservoir 93. The time needed to extend the cylinders so that the web travels from the horizontal position to an inclined position of about 50 degrees, can desirably be set at around 16 seconds by appropriate adjustment of second flow control valve 102 and first relief valve 98. With the one inch bore hydraulic cylinders 76, 78 described above and first relief valve 98 set for a breakdown pressure of about 300 psi, the flow setting of pressure compensated flow control valve 102 can be set at about 0.385 cubic feet per minute.

When it is desired to maintain the dual acting hydraulic cylinders 76, 78, at a particular degree of extension, and thus maintain the support rods 66, 68 and web 72 at a corresponding angle of inclination above the horizontal upper surface of the fluidized support system, two-way solenoid valve 104 is deactivated. This prevents flow from pump 91 through the check valve branch of pressure compensated flow control valve 101. It also prevents flow out of first chambers 95 and through first conduit line 86 and the pressure compensated flow control branch of pressure compensated flow control valve 101. Since no fluid is entering (or leaving for that matter) first chambers 95, pistons 80 are not moving and no hydraulic fluid is being expelled out of second chambers 96 of hydraulic cylinders 76, 78. If continued operation of pump 91 produces any buildup of pressure beyond the pressure setting of relief valve 98, valve 98 activates and returns the excess hydraulic fluid to reservoir 93 via channel B and port R.

When it is desired to withdraw the piston rod 84 within the dual acting hydraulic cylinders 76, 78, control valve 97 is deactivated, and thus configured so that the paths schematically indicated by the crossed arrows connect circuit 90 and circuit 89. In this deactivated configuration, control valve 97 connects pump 91 through channel B to the check valve branch of second pressure compensated flow control valve 102. Thus, hydraulic fluid is pumped under pressure to exit port B and enter second chambers 96 via second conduit line 88. In reaction to fluid entering second chambers 96 under pressure provided by pump 91, pistons 80 move so that piston rods 84 withdraw farther into cylinder members 82 and push hydraulic fluid out of first chambers 95 of hydraulic cylinder members 76, 78. However, the pressure compensated flow control branch of first pressure compensated flow control valve 101 is set to permit only a predetermined rate of hydraulic fluid flow. The predetermined rate of flow set for first pressure compensated flow control valve 101 is designed to limit the speed with which pistons 80, and accordingly support rods 66, 68, and web 72, move and thus controls the speed at which the patient's head and upper torso are lowered toward the upper surface of the fluidized support system. In this way, first pressure compensated flow control valve 101 controls the speed at which the patient's head and upper torso are lowered toward the upper surface of the fluidized support system. Simultaneous with deactivation of control valve 97, two-way solenoid valve 104 also is activated so as to permit flow from first chambers 95 entering port A via first conduit line 86 and passing through the pressure compensated flow control branch of first pressure compensated flow control valve 101, to return to reservoir 93 via channel A and port R. Because pump 91 continues to operate, pressure in excess of the preset level of second pressure relief valve 99 causes hydraulic fluid to flow from channel B through second pressure relief valve 99 and into channel A, where the fluid returns via port R to reservoir 93. The time needed to retract the fully extended piston rods 84 within their respective cylinder members 82 so that the web travels from a fully inclined position of about 50 degrees above the horizontal position to the horizontal position, can desirably be set at around 12 seconds by appropriate adjustment of first flow control valve 101 and second relief valve 99. With the one inch bore hydraulic cylinders 76, 78 described above and second relief valve 99 set for a breakdown pressure of about 25 psi, the flow setting of first pressure compensated flow control valve 101 can be set at about 0.385 cubic feet per minute.

Thus, configuration of the hydraulic circuit to raise web 72 above the surface of the fluidized support system, causes chambers 95 to become connected to pump 91 via port A and conduit line 86, while chambers 96 drain into reservoir 93 via port B and conduit line 88. Conversely, when control valve 97 is configured so that the paths schematically indicated by the crossed arrows connect circuit 90 with circuit 89, each second chamber 96 is connected to pump 91, while each first chamber 95 drains into reservoir 93. In this inactivated configuration of control valve 97, piston 80 moves so that piston rod 84 is retracted farther within cylinder member 82. Thus, so long as two-way valve 104 is activated, the configuration of control valve 97 determines whether piston rod 84 moves so as either to extend or retract its position relative to cylinder member 82. Deactivation of two-way valve 104 maintains the position of piston 80 and piston rod 84 relative to cylinder member 82.

In yet further accordance with the present invention, a means is provided for protecting against doing damage to an obstacle which may become interposed in the path of the carrying means as the carrying means is being lowered toward the surface of the fluidized support system. In a preferred embodiment of the interposed obstacle damage avoidance means, when the carrying means is being lowered toward the surface of the fluidized support system and the carrying means meets resistance, presumably by encountering a physical object, a reversing means is provided to reverse the direction of the carrying means so that it begins raising away from the surface of the fluidized support system and away from the object causing the resistance, thus preventing the carrying means from applying more than a nominal amount of force against the object, and then only for a very brief time. For example, when lower support rod 66 is being lowered from the inclined position (shown in FIGS. 1 and 5 for example) and encounters for example a person's hand between the lower support rod 66 and the upper surface of the fluidized support system 22, a pressure sensor, a means for detecting the location of each piston 80 disposed within the cylinder casing 82 of each dual acting hydraulic cylinder 76, 78, and an electrical relay cooperate so as to reverse the direction of movement of the support rods away from the surface of the fluidized support system so that the lower support rod does not apply force sufficient to injure the person's hand under foreseeable circumstances. The same result would occur if the hand were inserted between upper support rod 68 and lower support rod 66 and encountered upper support rod 68.

Figure 9:
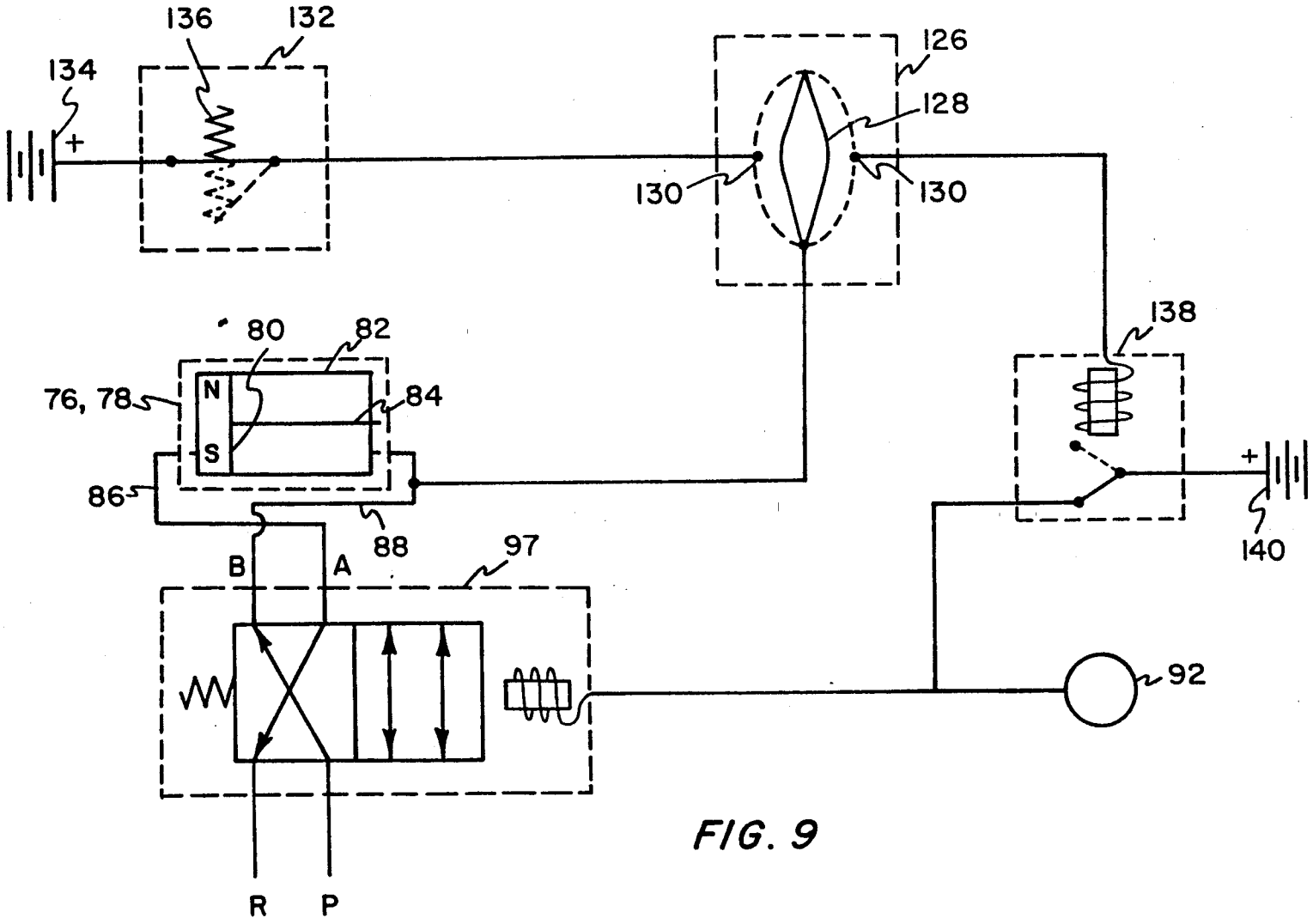
FIG. 9 illustrates a schematic diagram of components of a preferred embodiment of the apparatus of the present invention.

The interposed obstacle damage avoidance means includes a pressure sensor that senses the hydraulic pressure in channel B and generates an electrical signal according to the pressure sensed in channel B. As embodied herein and shown schematically in FIG. 8 for example, the pressure sensor of the obstacle damage avoidance means desirably is provided in the form of a pressure switch 126 disposed to monitor the pressure in channel B between relief valve 99 and flow control valve 102. In functional terms, which are schematically illustrated in FIG. 9 for example, pressure switch 126 acts as an electrically conducting diaphragm 128 disposed between a pair of electrical leads 130. The diaphragm expands in response to increases in pressure in channel B. The amount of this expansion is controlled by an adjustable spring (not shown), which can be set so that when a certain threshold pressure is attained in channel B, the diaphragm expands sufficiently to electrically connect the pair of electrical leads 130 (as schematically indicated in FIG. 9 by the dashed line configuration of diaphragm 128). Thus, pressure switch 126 is open until a threshold pressure has been attained. At this threshold pressure, pressure switch 126 becomes closed, and electrical current can pass through pressure switch 126. In the above-described preferred embodiment of the present invention, in which the maximum expected pressure in channel B would be about 25 to 40 psi during the lowering of the carrying means, the threshold pressure would be set at about 50 psi, give or take 5 psi.

In addition, as shown schematically in FIG. 8 for example, the obstacle damage avoidance means desirably includes a means for detecting the location of each piston 80 disposed within the cylinder casing 82 of each dual acting hydraulic cylinder 76, 78. As embodied herein and shown schematically in FIG. 9 for example, the piston position sensing means preferably includes a magnetic piston 80 provided in each double acting cylinder 76, 78 and a normally closed magnetic reed switch 132 associated with each cylinder 76, 78. Each reed switch 132 is normally closed to permit electrical current from an electrical power source 134 to pass through the switch. However, each reed switch 132 opens to break the electrical circuit when a magnetic piston 80 moves to a position within a certain distance from reed switch 132. As shown schematically in FIG. 9 for example, each of two reed switches 128 (only one is shown in FIG. 9 for the sake of simplicity) is disposed so that magnetic piston 80 opens (indicated in FIG. 9 by the dashed line) switch 132 when piston 80 reaches the end of chamber 95. In other words, as shown schematically in FIG. 9 for example, each reed switch 132 is located so that switch 132 becomes activated (opened) when magnetic piston 80 reaches its fully retracted position within its respective hydraulic cylinder casing 82. As shown schematically in FIG. 9 by spring 136, switch 132 automatically resets to the normally closed position when piston 80 moves away from the fully retracted position within cylinder casing 82.

As shown schematically in FIG. 9 for example, a relay 138 is provided and electrically connected to control directional control valve 97. In addition, relay 138 controls activation of motor 92. In its normally closed position (indicated in FIG. 9 by the solid line), relay 138 electrically connects an electrical power source 140 to power the solenoid of directional control valve 97 and to operate motor 92. Upon receiving an electrical signal from pressure switch 126 and reed switches 132, relay 138 becomes configured in its open position (indicated in FIG. 9 by the dashed line), in which relay 138 electrically disconnects power source 140 from the solenoid of directional control valve 97 and motor 92.

In explanation of the operation of the obstacle damage avoidance means, one must consider that when support rods 66, 68 are being lowered, piston 80 moves toward the blind end of cylinder member 82 and eventually becomes positioned where piston 80 no longer can move any farther toward the blind end of the hydraulic cylinder. When movement of piston 80 ceases, the pressure in channel B suddenly increases by an amount above the pressure in channel B during the movement of piston 80 toward the blind end of cylinder member 82. The amount of the increased pressure is sufficient to be detectable, yet not so low as to be caused by normal pressure transient fluctuations. Pressure switch 126 detects this sudden increased pressure in channel B. Such detection occurs for example by the passage of current through switch 126 upon the attainment of the threshold pressure of switch 126.

Moreover, when an object interrupts the path of the lowering support rods, a sudden significant pressure increase occurs in the pressure profile in channel B. For example, assuming that the object becomes interposed at a location closer to one hydraulic cylinder than the other hydraulic cylinder, the initial contact between the support rod and the object will arrest the piston 80 of the cylinder member 82 closest to the object before stopping piston 80 of the cylinder member farthest from the object. When one piston 80 stops, pump 91 continues to supply fluid through port B and second conduit line 88 to second chambers 96. Since one of the second chambers 96 cannot receive any more fluid because of the stoppage of its piston 80, the other second chamber 96 continues to accept fluid supplied by pump 91. Thus, during this phase of the event, the object does not bear the force of the pressure supplied by the hydraulic circuit, since fluid continues to flow into the other second chamber 96. Once the mechanical linkages arrest movement of the second piston in the hydraulic cylinder farthest from the object, neither piston moves within its respective cylinder member 82. From this moment, the continued operation of pump 91 continues to supply fluid, and the pressure significantly increases in channel B.

As shown schematically in FIG. 8 for example, the spring return of directional control valve 97 biases valve 97 in a configuration that permits two way flow between channel A and pump 91 and between channel B and reservoir 93. This is the configuration of valve 97 needed to effect the raising of the carrying means above the surface of the fluidized support system. Similarly, electrical activation of the solenoid of control valve 97 configures valve 97 to return hydraulic fluid via channel A into reservoir 93 and supply hydraulic fluid from pump 91 to channel B. This is the configuration of valve 97 needed to effect the lowering of the carrying means toward the surface of the fluidized support system.

During the normal lowering sequence of support rods 66, 68, reed switch 132 opens about one half second to about one second before pressure switch 126 closes in response to a significant increase in pressure in channel B. Accordingly, power source 134 is not connected to reconfigure relay 138 to deactivate direction control valve 97 and motor 92. However, upon channel B pressure switch 126 detecting a sudden increase in pressure before reed switch 132 opens in response to the presence of piston 80 at the blind end of cylinder member 82, the closing of pressure switch 126 reconfigures relay 138 into its reversal mode of operation.

In its reversal mode of operation, relay 138 deactivates the solenoid of directional control valve 97, and this allows the spring return of valve 97 to configure directional control valve 97 in a manner that supplies fluid from pump 91 to chambers 95. With this hydraulic configuration, support rods 66, 68 cease lowering and begin raising away from the surface of the fluidized support system and accordingly away from any obstacle which caused channel B pressure switch 126 to detect a sudden increase in pressure before the piston reaches the blind end of the cylinder in the normal lowering sequence. Moreover, relay 138 turns off pump 91, the excess pressure condition in channel B is relieved, and pressure switch 126 returns to its normally open condition. Moreover, switch (not shown) that enables the operator to initiate the support rod lowering sequence also resets relay 138 into its normally closed condition. In the event that the operator who is lowering the support rods fails to detect the presence of the obstacle and continues to activate the control unit to lower the support rods, the obstacle damage avoidance means is ready to repeat the support rod reversal sequence. Thus, the entire support rod reversing mechanism will repeat the reversal of the support rod downward movement should the support rods again encounter the obstacle.

Furthermore, even if the reed switch 132 on the hydraulic cylinders becomes faulty, the support rod reversal function continues to operate. This is because reed switch 132 is normally closed and pressure switch 126 will detect the pressure spike and reconfigure relay 138 to implement the reversal sequence for the support rods.

In an alternative embodiment of the interposed obstacle damage avoidance means, circuit 90 is configured so that when the carrying means is lowering the web toward the surface of the fluidized support system and the carrying means meets resistance, second relief valve 99 acts so as to relieve sufficient pressure in the hydraulic circuit to prevent the carrying means from applying more than a nominal amount of force against the resistance, and then only for a very brief time. For example, when lower support rod 66 is being lowered from the inclined position (shown in FIGS. 1 and 5 for example) and encounters for example a person's hand between the lower support rod 66 and the upper surface of the fluidized support system 22, circuit 90 would act to relieve sufficient pressure in the hydraulic circuit so that the lower support rod would not apply force sufficient to injure the person's hand under foreseeable circumstances. The same result would occur if the person's hand were inserted between upper support rod 68 and lower support rod 66 and encountered upper support rod 68.

As embodied herein and schematically shown in FIG. 8 for example, when the support rods are being lowered toward the upper surface of the fluidized support system, pump 91 can be connected to channel B via control valve 97. Relief valve 99 is set at a relatively low break down pressure of about 25 psi, and thus the maximum pressure in second chambers 96 is about 25 psi. Allowing for the one-inch diameters of pistons 80 and the area occupied by piston rods 84 and assuming a 100% efficient force transmittal through the remaining hydraulic and mechanical components of the apparatus, a nominal force of about 47 pounds is applied by the support rods against the resisting object. In reality, the frictional losses in the mechanical components and the pressure losses in the hydraulic circuit of the apparatus probably reduce the actual force transmitted to the object to about 35 pounds. Moreover, as explained hereafter, because of the configuration and operation of the hydraulic circuit, this is only a transient force of momentary duration on the order of less than one second.

For example, assuming that the object becomes interposed at a location closer to one hydraulic cylinder than the other hydraulic cylinder, the initial contact between the support rod and the object will arrest the piston 80 of the cylinder member 82 closest to the obstacle before stopping piston 80 of the cylinder member farthest from the obstacle. When one piston 80 stops, pump 91 continues to supply fluid through port B and second conduit line 88 to second chambers 96. Since one of the second chambers cannot receive any more fluid because of the stoppage of its piston 80, the other second chamber 96 continues to accept fluid supplied by pump 91. Thus, during this phase of the event, the object does not bear the force of the pressure supplied by the hydraulic circuit, since fluid continues to flow into the other second chamber 96. Once the mechanical linkages arrest movement of the second piston in the hydraulic cylinder farthest from the object, neither piston moves within its respective cylinder member 82. From this moment, the continued operation of pump 91 continues to supply fluid, and the pressure increases in channel B. During this pressure build-up phase of the event, the pressure being supplied by pump 91 is transmitted to the object, but at less than 100% efficiency (because of frictional and pressure losses). Once the pressure in channel B triggers second pressure relief valve 99, additional supply of hydraulic fluid by pump 91 is returned to reservoir 93 via second relief valve 99, channel A, and port R. Moreover, once the second pressure relief valve 99 transmits flow, the pressure in channel A attains an equilibrium with the pressure in channel B. Since the pressure in channel A equals the pressure in channel B, the pressures on both sides of pistons 80 are nominally equalized. However, because of the amount of piston area displaced by piston rod 84, the actual force applied to pistons 80 from the side of first chambers 95 exceeds the force applied from the side of second chambers 96 containing piston rods 84. The excess force is applied against the force of gravity that applies to the head and upper torso of the patient. Thus, once this pressure equalizing event has been attained, force actually is applied against the weight of the patient's own head and upper torso to reduce the net force being applied to the object. Moreover, it is only during the period beginning with the pressure build-up phase and ending with the attainment of the pressure equalizing phase, that any excess force is applied to the resisting object.

Furthermore, since second pressure relief valve 99 is preset at the nominal operating pressure of the hydraulic system during the lowering of the support rods toward the surface of the fluidized support system, second pressure relief valve 99 triggers in an instant. In addition, very little time is required for channel A to attain an equilibrium pressure with channel B. Accordingly, the configuration and operation of the hydraulic circuit of the present invention safeguards against foreseeable injury to the patient during encounters with the lowering support rods.

In still further accordance with the present invention, means can provided to rapidly lower the patient from an inclined position to a completely supine position in order to facilitate performance of an emergency procedure such as cardiopulmonary resuscitation (CPR). As embodied herein, the hydraulic fluid circuit can further include a solenoid valve configured and disposed so that when it becomes desirable to rapidly lower support rods 66, 68 from an elevated (inclined) position to a completely lowered position (shown in FIGS. 2 and 3 for example) on the upper surface of the fluidized support system, the solenoid valve acts so as to depressurize the hydraulic circuit in a manner that permits the support rods to rapidly lower themselves. As embodied herein and shown in FIG. 8 for example, a solenoid valve 100 is disposed in hydraulic circuit 90. As shown schematically in FIG. 8 for example, control valve 97 can be configured so that first hydraulic conduit line 86 is connected to reservoir 93 and second hydraulic conduit line 88 is connected to pump 91 via channel A. Solenoid valve 100 is disposed in that portion of hydraulic circuit 90 so as to bypass the pressure relief valves 98, 99, two-way solenoid valve 104, and the pressure compensated flow control valves 101, 102. Spring return solenoid valve 100 can then be actuated to return hydraulic fluid from first chamber 95 to reservoir 93. Activation of solenoid valve 100 creates a pressure differential between first chambers 95 and second chambers 96 so as to retract pistons 80 and piston rods 84 within cylinder members 82 and force hydraulic fluid out of first chambers 95. The flow rate of hydraulic fluid from chambers 95 is no longer determined by the flow setting of first pressure compensated flow control valve 101. Instead, the flow rate at which hydraulic fluid drains from first chambers 95 is determined essentially by the balance of gravitational and frictional forces, and such balance typically results in complete retraction of a fully extended piston 80 after about 4 seconds.

In yet further accordance with the present invention, the hydraulic fluid circuit can further include a manually actuatable valve configured and disposed so that when it becomes desirable to rapidly lower support rods 66, 68 from an elevated or inclined position to a completely lowered position (shown in FIGS. 2 and 3 for example) on the upper surface of the fluidized support system and electric power is not available to activate solenoid valve 100, the manual valve can be activated so as to depressurize the hydraulic circuit in a manner that permits the support rods to rapidly lower themselves. As embodied herein and shown schematically in FIG. 8 for example, a manual valve 106 is disposed in that portion of hydraulic circuit 90 so as to bypass control valve 97 and solenoid valve 100 as well as the pressure relief valves 98, 99, two-way solenoid valve 104, and the pressure compensated flow control valves 101, 102. Manual valve 106 can then be actuated manually to return hydraulic fluid from first chambers 95 to reservoir 93. Activation of manual valve 106 creates a pressure differential between first chambers 95 and second chambers 96 so as to retract pistons 80 and piston rods 84 within cylinder members 82 and force hydraulic out of first chambers 95. The flow rate of hydraulic fluid from chambers 95 is no longer determined by the flow setting of first pressure compensated flow control valve 101. Instead, the draining flow rate is determined essentially by the balance of gravitational and frictional forces, and such balance typically results in complete retraction of a fully extended piston 80 after about 4 seconds.

Desirably, hydraulic conduit lines carrying pressurized hydraulic fluid should be restrained. As embodied herein and shown in FIG. 2 for example, first hydraulic conduit line 86 and second hydraulic conduit line 88 carry hydraulic fluid for the dual acting hydraulic cylinders 76, 78. Thus, first hydraulic conduit line 86 and second hydraulic conduit line 88 extend through channel 46. Moreover, channel 46 and the depending support flanges 42 cooperate to provide support for hydraulic conduit lines 86, 88 and so remove the necessity for such lines to carry their own weight.

Figure 7:
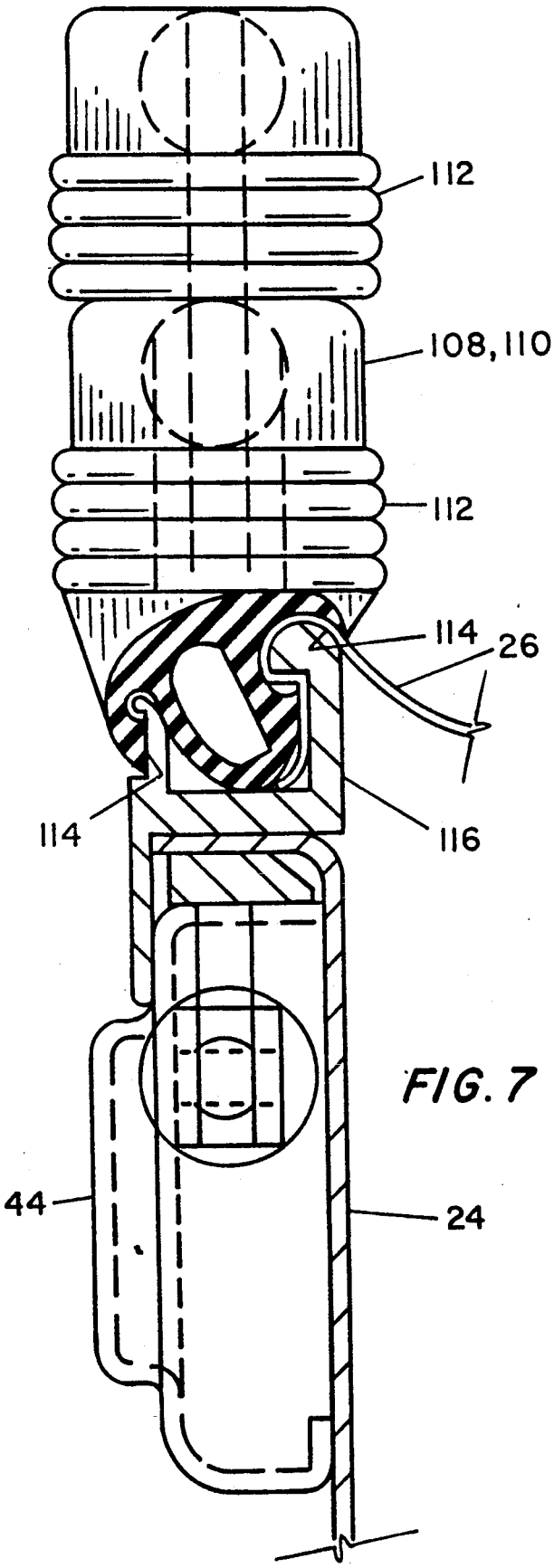
FIG. 7 illustrates components of a preferred embodiment of the apparatus of the present invention taken from an end view partially in cross-section and partially in plan.

In further accordance with the present invention, means are provided to shield the occupant of the fluidized patient support system from the moving mechanical parts of the apparatus of the present invention. As embodied herein and shown in FIGS. 2–5 for example, a first flexible bellows is generally designated by the numeral 108. Bellows 108 is configured to cover a second splice bar linkage, which is hidden in the FIGS. by bellows 108. Similarly, as shown in FIG. 1 for example, a second flexible bellows 110 is configured to cover first splice bar linkage 48 disposed on the opposite side of fluidized support system 22. As shown in FIGS. 1–5 for example, each flexible bellows 108, 110 defines a stepped configuration to house the stepped configuration of each splice bar linkage 48. As shown in FIGS. 1–5 for example, each flexible bellows 108, 110 is configured to expand and contract so as to accommodate the pivoting movement of the splice bar linkage housed within the flexible bellows. As shown in FIG. 1–5 and 7 for example, each flexible bellows defines at least one pleated portion 112 along vertically extending walls. Moreover, as shown in FIG. 7 for example, the lower edges 114 of each bellows is further configured to engage the periphery of filter cover sheet 26 of the fluidized support system and hold it in a fashion that does not permit the escape of any of the fluidizable material past the filter sheet edge held by the lower edge of the flexible bellows. Thus, each flexible bellows performs a sealing function by gripping the edge of the filter sheet cover of the fluidized support system and anchoring this edge to the upper side lip 116 of tank 24, which contains the fluidizable mass of material carried by the fluidized support system.

As embodied herein and shown in FIG. 2 for example, a first cushioning member 118 is provided and defines a cylindrical sheath of high density foam or rubber material that surrounds the portion of lower support rod 66 disposed between the first and second ends that define the slots or are connected to the distal end of the first and second splice bar linkages 48. As shown in FIG. 2 for example, first cushioning member 118 defines an opening 120 near each end thereof to permit access to the attaching screw which connects the end of lower support rod 66 to the distal end (not shown) of splice bar linkage 48. First cushioning member 118 defines a smooth outer surface and provides cushioning protection about the rigid lower support rod. Similarly, a second cushioning member 122 is provided to surround upper support rod 68. Second cushioning member 122 also defines a smooth outer surface of an annular cylindrically shaped extrusion of heavy density foam or rubber. Second cushioning member 122 is disposed to surround the portion of upper support rod 68 between the first and second ends of upper support rod 68. The smooth outer surfaces of the cushioning members carried respectively by the lower support rod and the upper support rod permit the flexible web 72 to glide over these surfaces in an unencumbered fashion when separation occurs between upper support rod 68 and lower support rod 66 to render flexible web 72 taut.

In accordance with the operational method of the present invention, a method is provided for inclining the head and upper torso of the occupant of a fluidized support system above the fluidized upper surface of the fluidized support system. A loosely draped web 72 of air permeable material is interposed between the head and upper torso of the occupant of the fluidized support system and the upper surface of the fluidized support system. In addition to being interposed between the occupant and the upper surface of the fluidized support system, the web of filter sheet material is carried by a pair of support rods 66, 68 which can be pivoted with respect to one another to a maximum deflection of about 15°. The web is rendered taut beneath the occupant by pivoting one support rod relative to another. As shown in FIGS. 3–5 for example, the taut web then is pivoted above the fluidized upper surface of the fluidized support system so as to incline the head and upper torso of the occupant above the fluidized upper surface of the fluidized support system. As described above, the pivoting of the taut web above the upper surface of the fluidized support system can be accomplished by pivoting one end of the support rods above the upper surface of the fluidized support system and thus carrying the web on the pivoting support rods.

Desirably, before the taut web begins pivoting above the surface of the fluidized support system, the fluidization of the mass of fluidizable material is discontinued, desirably by shutting off the source of fluidizing air. This defluidization occurs so that while the head and upper torso of the occupant is being inclined above the surface of the fluidized support system, the defluidized mass of material prevents the occupant from sliding in response to the force being applied to the occupant in the horizontal direction toward the foot of the fluidized support system. The coordination of the discontinuation of the source of fluidizing air with the inclination of the web can be effected by suitably connected electrical switches (or by a suitably preprogrammed microprocessor unit) which controls the source of fluidizing air and the pump and various valves of the hydraulic circuit.

If it is desirable to perform an emergency procedure such as cardiopulmonary resuscitation (CPR), it is possible to rapidly lower the web in about 4 seconds, even from the maximum inclined position, which is about 50° above the horizontal. This rapid lowering of the taut web is accomplished by activating the solenoid valve 100 (FIG. 8) which drains the portion of the hydraulic circuit that maintains the pistons and piston rods of each dual acting cylinder in an extended position.

Desirably, the upper surface of the fluidized support system is defluidized during the step of rapidly lowering the taut web to the surface of the fluidized support system. In this way, by the time that the taut web reaches the surface of the fluidized support system, and has lowered the patient from the inclined position to a supine position on the upper surface of the fluidized support system, a firm support surface will be disposed beneath the occupant of the support system. Then the attendants of the occupant will be able to carry out a CPR or other emergency procedure requiring a firm support surface beneath the occupant of the support system.

What is claimed is:

1. A combination fluidized support system and apparatus for inclining the head and upper torso of an occupant of the fluidized support system above the fluidized upper surface of the fluidized support system, the apparatus comprising:
(a) means for attaching the apparatus to the fluidized support system;
(b) means for carrying the head and upper torso of the occupant of the fluidized support system;
i) said carrying means being pivotally connected to said attaching means; and
(c) means for pivoting one end of said carrying means above the fluidized upper surface of the fluidized support system,
i) said pivoting means being pivotally connected to said carrying means.

2. An apparatus as in claim 1, further comprising:
(d) means for protecting against doing damage to an obstacle which may become interposed in the path of the carrying means as the carrying means is being lowered toward the surface of the fluidized support system.

3. An apparatus as in claim 2, wherein:
(d) said means for protecting against doing damage to an obstacle which may become interposed in the path of the carrying means as the carrying means is being lowered toward the surface of the fluidized support system includes:
i) means for reversing the lowering direction of said carrying means to the direction for raising said carrying means.

4. An apparatus as in claim 3, wherein:
(d) said reversing means includes:
i) a pressure sensor disposed to sense an increase in pressure caused by the encounter between said carrying means and the interposed obstacle.

5. An apparatus as in claim 4, wherein:
(d) said reversing means includes:
ii) a relay actuated by said pressure sensor to trigger said carrying means to reverse direction from a direction lowering toward the upper surface of the fluidized of support system to a direction raising away from this upper surface.

6. An apparatus as in claim 1, wherein:
said means for attaching the apparatus to the fluidized support system includes:
i) means for pivotally connecting said carrying means to at least one side of the fluidized support system, and
ii) means for connecting said pivoting means to at least one side of the fluidized support system.

7. An apparatus for inclining the head and upper torso of an occupant of a fluidized support system above the fluidized upper surface of the fluidized support system, the apparatus comprising:
(a) means for attaching the apparatus to the fluidized support system;
(b) means for carrying the head and upper torso of the occupant of the fluidized support system,
i) said carrying means being pivotally connected to said attaching means;
(c) means for pivoting one end of said carrying means above the fluidized upper surface of the fluidized support system,
i) said pivoting means being pivotally connected to said carrying means; and wherein:
said means for attaching the apparatus to the fluidized support system includes:
i) a mounting bracket,
ii) said mounting bracket being configured to be attached to a side of a fluidized support system,
iii) said mounting bracket defining a first mounting flange extending from a first side of said mounting bracket,
iv) said first mounting flange being pivotally connected to said carrying means,
v) said mounting bracket defining a second mounting flange extending from a second side of said mounting bracket,
vi) said second mounting flange being pivotally connected to said pivoting means,
v) said mounting bracket defining an elongated slotted opening, and
vi) a portion of said carrying means extending from said first side of said mounting bracket through said slotted opening and pivotally connected to said pivoting means on said second side of said mounting bracket.

8. An apparatus for inclining the head and upper torso of an occupant of a fluidized support system above the fluidized upper surface of the fluidized support system, the apparatus comprising:
means for attaching the apparatus to the fluidized support system;
means for carrying the head and upper torso of the occupant of the fluidized support system,
i) said carrying means being pivotally connected to said attaching means;
means for pivoting one end of said carrying means above the fluidized upper surface of the fluidized support system,
i) said pivoting means being pivotally connected to said carrying means; and wherein:
said means for carrying the head and upper torso of the occupant of the fluidized support system includes:
(a) a first lifting linkage;
i) said first lifting linkage generally defining an L-shaped form, and
ii) said first lifting linkage having a toe end;
(b) a second lifting linkage,
i) said second lifting linkage generally defining an L-shaped form, and
ii) said second lifting linkage having a toe end; and
(c) a lower support rod,
i) said lower support rod having a first end and a second end,
ii) said first end of said lower support rod being pivotally connected to a first side of the support system,
iii) said first end of said lower support rod defining a slot for receiving said first lifting linkage therethrough,
iv) said first lifting linkage being disposed to pass through said slot define through said first end of said lower support rod, v) said first lifting linkage being pivotally connected to said lower support rod, vi) said second end of said lower support rod being pivotally connected to the second side of the support system, vii) said second end of said lower support rod defining a slot for receiving said second lifting linkage therethrough, viii said second lifting linkage being disposed to pass through said slot defined through said second end of said lower support rod, and ix) said second lifting linkage being pivotally connected to said lower support rod.

9. An apparatus as in claim 8, further comprising:

(d) an upper support rod, i) said upper support rod having a first end and a second end, ii) said upper support rod having said first end connected to said first lifting linkage, and iii) said upper support rod having said second end connected to said second lifting linkage.

10. An apparatus as in claim 9, further comprising:

(e) a second cushioning member surrounding the portion of said upper support rod disposed between said first and second ends connecting to said lifting linkages.

11. An apparatus as in claim 10, wherein said second cushioning member defines a smooth outer surface.

12. An apparatus as in claim 9, wherein: said means for carrying the head and upper torso of the occupant of the fluidized support system further includes:

(e) a flexible air permeable web carried by said upper support rod and said lower support rod.

13. An apparatus as in claim 12, wherein said flexible air permeable web is formed as an integral part of the filter sheet cover of the fluidized support system.

14. An apparatus as in claim 8, further comprising:

(e) a first cushioning member surrounding the portion of said lower support rod disposed between said first and second ends defining said slots.

15. An apparatus as in claim 8, wherein: said means for pivoting one end of said carrying means above the fluidized upper surface of the fluidized support system includes:

(a) a first dual acting hydraulic cylinder, i) said first dual acting hydraulic cylinder having a first one of its ends being configured for pivotally connecting to a first side of the fluidized support system, and ii) said first dual acting hydraulic cylinder having a second one of its ends being pivotally connected to said toe end of said first lifting linkage; and (b) a second dual acting hydraulic cylinder, i) said second dual acting hydraulic cylinder having a first one of its ends being configured for pivotally connecting to a second side of the fluidized support system, and ii) said second dual acting hydraulic cylinder having a second one of its ends being pivotally connected to said toe end of said second lifting linkage.

16. An apparatus as in claim 15, further comprising:

a first splice bar linkage defining a main body member, said main body member defining a further slot therethrough, said further slot receiving said L-shaped first lifting linkage therethrough wherein said further slot defined through said main body member of said first splice bar linkage is configured so that pivoting movement of said L-shaped first lifting linkage disposed through said further slot is restrained to a predetermined range of arcuate movement corresponding to less than the full length of travel capability of said first dual acting hydraulic cylinder's piston.

17. A combination fluidized support system and apparatus for inclining the head and upper torso of the occupant of the fluidized support system above the fluidized upper surface of the fluidized support system, the apparatus comprising:

(a) means for attaching the apparatus to the fluidized support system;

(b) means for carrying the head and upper torso of the occupant of the fluidized support system, i) said carrying means being pivotally connected to said attaching means;

(c) means for pivoting one end of said carrying means above the fluidized upper surface of the fluidized support system, i) said pivoting means being pivotally connected to said carrying means; and; wherein: said means for pivoting one end of said carrying means above the fluidized upper surface of the fluidized support system includes:

(d) a first dual acting hydraulic cylinder, i) said first dual acting hydraulic cylinder having a first one of its ends being pivotally connected to a first side of the fluidized support system; and (e) a second dual acting hydraulic cylinder, i) said second dual acting hydraulic cylinder having a first one of its ends being pivotally connected to a second side of the fluidized support system.

18. An apparatus as in claim 17, further comprising:

(f) means for protecting against doing damage to an obstacle which may become interposed in the path of the carrying means as the carrying means is being lowered toward the surface of the fluidized support system.

19. An apparatus as in claim 18, wherein:

(f) said means for protecting against doing damage to an obstacle which may become interposed in the path of the carrying means as the carrying means is being lowered toward the surface of the fluidized support system includes:

i) means for reversing the lowering direction of said carrying means to the direction for raising said carrying means.

20. An apparatus as in claim 17, further comprising:

(f) means for protecting against doing damage to an obstacle which may become interposed in the path of the carrying means as the carrying means is being lowered toward the surface of the fluidized support system, (g) said damage protection means including:

i) means for reversing the lowering direction of said carrying means to the direction for raising said carrying means, wherein:

(h) said reversing means includes:

i) an hydraulic fluid circuit for supplying hydraulic fluid under pressure to said first and second dual acting hydraulic cylinders, and ii) said hydraulic circuit including at least one pressure sensor disposed to sense an increase in pressure caused by the encounter between said carrying means and the interposed obstacle.

21. An apparatus as in claim 20, wherein:

(d) said reversing means includes:
iii) a relay actuated by said pressure sensor to trigger said carrying means to reverse direction form lowering toward the upper surface of the fluidized of support system to raising away from this upper surface.

22. An apparatus as in claim 21, wherein:
(d) at least one of said hydraulic cylinders includes a piston and said reversing means includes:
iv) means for sensing the position of at least one of said pistons, and
v) said piston position sensing means being connected to supply power to said pressure sensor.

23. An apparatus as in claim 22, wherein:
(d) said at least one piston includes a magnetic member and said piston position sensing means includes a magnetic reed switch.

24. An apparatus as in claim 17, further comprising:
(f) an hydraulic fluid circuit for supplying hydraulic fluid under pressure to said first and second dual acting hydraulic cylinders,
i) said hydraulic circuit including at least one pressure relief valve disposed so that when said carrying means meets resistance when being lowered from an elevated position to a relatively lower position, then said relief valve acts to relieve sufficient pressure in said hydraulic circuit so that said carrying means cannot apply damaging force against said resistance.

25. An apparatus as in claim 17, further comprising:
(f) an hydraulic fluid circuit for supplying hydraulic fluid under pressure to said first and second dual acting hydraulic cylinders,
i) said hydraulic circuit including at least one pressure compensated flow control valve,
ii) said pressure compensated flow control valve being selectively resettable for the rate of flow desired through said pressure compensated flow control valve, and
iii) said pressure compensated flow control valve being disposed to control the actuation speed of said hydraulic cylinders in one of the expansion or contraction modes of operation of said hydraulic cylinders.

26. An apparatus as in claim 25, wherein:
i) said pressure compensated flow control valve includes a check valve branch and a pressure compensated flow control branch.

27. An apparatus as in claim 17, further comprising:
(f) an hydraulic fluid circuit for supplying hydraulic fluid under pressure to said first and second dual acting hydraulic cylinders,
i) said hydraulic circuit including at least one dump valve,
ii) said dump valve being manually actuatable,
iii) said dump valve being disposed so that upon being manually actuated under a condition where electrical power is not being provided to the apparatus, said dump valve provides a direct path for draining hydraulic fluid from the chambers of said hydraulic cylinders involved in maintaining said carrying means in an elevated position above the upper surface of the fluidized support system.

28. An apparatus as in claim 17, further comprising:
(f) an hydraulic fluid circuit for supplying hydraulic fluid under pressure to said first and second dual acting hydraulic cylinders,
i) said hydraulic circuit including at least one dump valve,
ii) said dump valve being an electrically actuatable solenoid valve,
iii) said dump valve being disposed so that upon being actuated said dump valve provides a direct path for draining hydraulic fluid from the chambers of said hydraulic cylinders involved in maintaining said carrying means in an elevated position above the upper surface of the fluidized support system.

29. An apparatus for inclining the head and upper torso of an occupant of a fluidized support system above the fluidized upper surface of the fluidized support system, the apparatus comprising:
(a) means for attaching the apparatus to the fluidized support system;
(b) means for carrying the head and upper torso occupant of the fluidized support system,
i) said carrying means being pivotally connected to said attaching means; and
(c) means for pivoting one end of said carrying means above the fluidized upper surface of the fluidized support system,
i) said pivoting means being pivotally connected to said carrying means, wherein:
said means for carrying the head and upper torso of the occupant of the fluidized support system includes:
(d) a first splice bar linkage,
i) said first splice bar linkage defining a main body member,
ii) said main body member of said first splice bar linkage defining a first end and a second end disposed opposite said first end,
iii) said main body member of said first splice bar linkage defining an elongated slot through a portion of said main body member,
iii) said slot through said main body member defining a cam follower extending within said slot,
iv) said first splice bar linkage defining a generally L-shaped flange wherein the shorter leg of the L-shaped flange defines a toe end,
v) said L-shaped flange being pivotally mounted to extend through said slot defined in said main body member of said first splice bar linkage,
vi) said L-shaped flange defining a cam surface configured and disposed to engage said cam follower defined in said slot, and
vii) wherein the range of pivoting movement of said L-shaped flange is limited to a predetermined arcuate amount by the interaction between said cam and said cam follower.

30. An apparatus as in claim 29, further comprising:
(e) at least a first flexible bellows configured to cover said first splice bar linkage and expand and contract to accommodate pivoting movement of said first splice bar linkage.

31. An apparatus as in claim 30, wherein:
i) said first flexible bellows is further configured to engage the filter cover sheet of the fluidized support system.

32. An apparatus as in claim 29, wherein: said means for carrying the head and upper torso of the occupant of the fluidized support system further includes:
(e) a lower support rod,
i) said lower support rod having a first end and a second end, ii) said first end of said lower support rod being attached to said first end of said main body member of said first splice bar linkage, and iii) said second end of said main body member of said first splice bar linkage being pivotally connected to the first side of the support system; and (f) an upper support rod, i) said upper support rod having a first end and a second end, and ii) said upper support rod having said first end attached to said L-shaped flange of said first splice bar linkage.

33. An apparatus as in claim 32, wherein: said means for pivoting one end of said carrying means above the fluidized upper surface of the fluidized support system includes:

(g) a first dual acting hydraulic cylinder, i) said first dual acting hydraulic cylinder having a piston hydraulically connected to a cylinder member, ii) said first dual acting hydraulic cylinder having a first end and a second end disposed opposite said first end, iii) said first dual acting hydraulic cylinder having one of its ends connected to said piston and one of its ends connected to said cylinder member, iv) said first dual acting hydraulic cylinder having said first one of its ends being configured for pivotally connecting to a first side of the fluidized support system, and v) said first dual acting hydraulic cylinder having said second one of its ends being pivotally connected to said toe end of said L-shaped flange of said first splice bar linkage.

34. An apparatus as in claim 32, further comprising:

(g) a first dual acting hydraulic cylinder;

i) said first dual acting hydraulic cylinder having a first one of its ends being configured for pivotally connected to said main body member of said first splice bar linkage, and ii) said first dual acting hydraulic cylinder having a second one of its ends being pivotally connected to said toe end of said L-shaped flange of said first splice bar linkage; and (h) an hydraulic fluid circuit for supplying hydraulic fluid under pressure to at least said first dual acting hydraulic cylinder, i) said hydraulic circuit including at least a first relief valve disposed so that when at least one of said support rods meets resistance when being lowered from an elevated position to a relatively lower position, then said relief valve acts to relieve sufficient pressure in said hydraulic circuit so that said support rod cannot apply damaging force against said resistance.

35. An apparatus as in claim 32, further comprising:

(g) a first dual acting hydraulic cylinder, i) said first dual acting hydraulic cylinder having a first one of its ends being configured for pivotally connecting to said main body member of said first splice bar linkage, and ii) said first dual acting hydraulic cylinder having a second one of its ends being pivotally connected to said toe end of said L-shaped flange of said first splice bar linkage; and (h) an hydraulic fluid circuit for supplying hydraulic fluid under pressure to said first dual acting hydraulic cylinder, i) said hydraulic circuit including a valve disposed so that when it is desired to rapidly lower said support rods from an elevated position to a completely lowered position, then said valve acts to depressurize said hydraulic circuit so that said support rods are rapidly lowered.

36. An apparatus for elevating the head and upper torso of the occupant of a fluidized support system above the fluidized upper surface of the fluidized support system, the apparatus comprising:

(a) a first dual acting hydraulic cylinder, i) said first dual acting hydraulic cylinder having a first one of its ends being pivotally connected to a first side of the fluidized support system;

(b) a second dual acting hydraulic cylinder having a first one of its ends being pivotally connected to a second side of the fluidized support system;

(c) a first lifting linkage, i) said first lifting linkage generally defining an L-shaped form, ii) said first lifting linkage having a toe end pivotally connected to the second one of the ends of said first dual acting hydraulic cylinder;

(d) a second lifting linkage, i) said second lifting linkage generally defining an L-shaped form, ii) said second lifting linkage having a toe end pivotally connected to the second one of the ends of said second dual acting hydraulic cylinder;

(e) a lower support rod, i) said lower support rod having a first end and a second end, ii) said first end of said lower support rod being pivotally connected to the first side of the support system, iii) said first end of said lower support rod defining a slot for receiving said first lifting linkage therethrough, iv) said first lifting linkage being disposed to pass through said slot defined through said first end of said lower support rod, v) said first lifting linkage being pivotally connected to said lower support rod, vi) said second end of said lower support rod being pivotally connected to the second side of the support system, vii) said second end of said lower support rod defining a slot for receiving said second lifting linkage therethrough;

viii said second lifting linkage being disposed to pass through said slot defined through said second end of said lower support rod, and ix) said second lifting linkage being pivotally connected to said lower support rod;

(f) an upper support rod, i) said upper support rod having a first end and a second end, ii) said upper support rod having said first end connected to said first lifting linkage, and iii) said upper support rod having said second end connected to said second lifting linkage; and (g) wherein each of said slots defined in said ends of said lower support rod is configured so that said respective lifting linkage disposed through said slot abuts one end of said slot when said piston of said respective hydraulic cylinder extends less than the full length of said piston's travel capability.

* * * * *